US006898401B2

(12) United States Patent
Okano et al.

(10) Patent No.: US 6,898,401 B2
(45) Date of Patent: May 24, 2005

(54) CHARGING SYSTEM, PROCESS CARTRIDGE AND IMAGE FORMING APPARATUS

(75) Inventors: Keiji Okano, Shizuoka (JP); Masahiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/418,055

(22) Filed: Apr. 18, 2003

(65) Prior Publication Data

US 2004/0022558 A1 Feb. 5, 2004

(30) Foreign Application Priority Data

Apr. 23, 2002 (JP) ..... 2002/120299

(51) Int. Cl.[7] ..... G03G 15/02
(52) U.S. Cl. ..... 399/176
(58) Field of Search ..... 399/149, 150, 399/116, 159, 174, 176

(56) References Cited

U.S. PATENT DOCUMENTS

| | | | | |
|---|---|---|---|---|
| 5,589,918 A | | 12/1996 | Oshida et al. | 399/114 |
| 5,682,574 A | | 10/1997 | Oshida et al. | 399/64 |
| 6,128,462 A | | 10/2000 | Kato et al. | 399/350 |
| 6,169,869 B1 | | 1/2001 | Inami et al. | 399/159 |
| 6,175,703 B1 | | 1/2001 | Nakazono et al. | 399/111 |
| 6,212,346 B1 | * | 4/2001 | Hirabayashi et al. | 399/176 |
| 6,337,964 B2 | | 1/2002 | Inami et al. | 399/254 |
| 6,343,193 B1 | | 1/2002 | Matsumoto et al. | 399/27 |
| 6,343,199 B1 | * | 1/2002 | Kodama | 399/174 |
| 6,532,030 B2 | | 3/2003 | Okano et al. | 347/131 |
| 6,539,190 B2 | | 3/2003 | Oba et al. | 399/174 |
| 6,549,742 B1 | * | 4/2003 | Chigono et al. | 399/174 |
| 6,615,010 B2 | * | 9/2003 | Hirabayashi et al. | 399/174 |
| 6,647,229 B2 | * | 11/2003 | Haraguchi et al. | 399/149 |
| 6,684,042 B2 | * | 1/2004 | Nagamori et al. | 399/176 |

FOREIGN PATENT DOCUMENTS

JP 07140758 A * 6/1995 ..... G03G/15/02

* cited by examiner

*Primary Examiner*—Robert Beatty
(74) *Attorney, Agent, or Firm*—Fitzpatrick, Cella, Harper & Scinto

(57) ABSTRACT

A charging system includes a rotatable member to be charged, and a rotatable charging member provided with electroconductive particles thereon and forming a nip part with the member to be charged and disposed in the nip part to charge the member to be charged. When the diameter of the member to be charged is defined as LD (mm) and the diameter of the charging member is defined as LC (mm), LD≦25 and LD×LC≧350. As a result,, in the charging system, and a process cartridge and an image-forming apparatus including such a charging system, an image-bearing member can be made small in diameter.

48 Claims, 11 Drawing Sheets

CHARGING SYSTEM, PROCESS CARTRIDGE AND IMAGE FORMING APPARATUS

BACKGROUND OF THE INVENTION

1. Field of the Invention

This invention relates to a charging system for charging a member to be charged, a process cartridge and an image-forming apparatus, and these are preferably used in copying machines and printers of the electrophotographic type and the electrostatic-recording type. As the member to be charged, use can be made of a photosensitive member or a dielectric member.

2. Description of Related Art (A) Process Cartridge

Heretofore, in an electrophotographic image-forming apparatus using an electrophotographic image forming process, there has been adopted a process-cartridge system in which an electrophotographic photosensitive member as an image-bearing member, which is a member to be charged, and at least one of charging means, developing means and cleaning means as process means for acting on the electrophotographic photosensitive member are integrally made into a process cartridge, which is made detachably mountable with respect to an electrophotographic image-forming apparatus main body.

According to this process-cartridge system, the maintenance of the image-forming apparatus can be done by a user himself without resort to a serviceman and therefore, operability can be markedly improved. So, this process-cartridge system is widely used in electrophotographic image-forming apparatuses. In such a process-cartridge system, operability for a user and a lower cost are desired and therefore, it is desirable to make particularly the diameter of a photosensitive member, which is an image-bearing member, small.

(B) Toner-Recycle Process (Cleanerless System)

In an image-forming apparatus of a transfer type, any untransferred residual developer (untransferred toner) on an image-bearing member after transfer is removed from the surface of the image-bearing member by a cleaning apparatus (cleaner) and becomes waste toner, and it is desirable from the viewpoint of environmental protection that this waste toner be not discarded.

So, there has appeared even an image-forming apparatus using a toner-recycle process (toner-recycle system or cleanerless system) which is of an apparatus construction in which an exclusive cleaner is eliminated, and any untransferred toner on an image-bearing member after transfer is removed from the image-bearing member by "cleaning simultaneous with developing" by a developing apparatus, and is collected for reuse in the developing apparatus.

"Cleaning simultaneous with developing" is a method of collecting any residual toner on an image-bearing member after transfer during developing subsequent to the next step, i.e., in an electrophotographic process, when continuing to charge the image-bearing member, exposing it to thereby form a latent image, and developing this latent image, by a fog-removing bias (a fog-removing potential difference V back which is the potential difference between a DC voltage applied to a developing apparatus and the surface potential of the image-bearing member).

According to this method, the untransferred toner is collected into the developing apparatus and reused at the next and subsequent steps and therefore, waste toner can be eliminated and the cumbersomeness for maintenance can be reduced. Also, because it is cleanerless, the advantage in space is also great and it becomes possible to greatly downsize the image-forming apparatus or the process cartridge.

In the toner-recycle process, the untransferred toner is once introduced into a contact-charging member and is made to enter a reusable state (the original charge amount of the toner) and is returned to the developing apparatus through the intermediary of the image-bearing member, whereby it is again used for developing, or if unnecessary, is collected. As a result, toner recycling becomes possible. In a charging apparatus used here, besides the charging of the image-bearing member, the collection of the untransferred toner and the recharging of the toner become necessary.

(C) Particle Charging (Powder-Applying Type)

There have been proposed a charging apparatus (a powder-applying-type, direct injection-charging apparatus) for charging an image-bearing member by direct injection charging with non-magnetic electroconductive particles being present in a charging-contact part (nip part) formed by the image-bearing member and a contact-charging member, and an image-forming apparatus using a toner-recycling process (a cleanerless system) utilizing the same. In this system, in order to supply electroconductive particles to the charging-nip part, it is desirable to supply the electroconductive particles from a developing device to the image-bearing member, and consequently, it is preferable to be of a cleanerless type in order that the electroconductive particles supplied to the image-bearing member may be stably supplied to the charging-nip part.

A suitable amount of the electroconductive particles contained in a developer in the developing apparatus shifts to the image-bearing member together with the toner during the development of an electrostatic latent image. A toner image on the image-bearing member is attracted and positively shifts to a transfer-material side in a transferring-nip part under the influence of a transferring bias, but the electroconductive particles on the image-bearing member, due to their being electroconductive, do not positively shift to the transfer-material side, and substantially adhere to and are retained on the image-bearing member and are residual thereon. The residual electroconductive particles on the surface of the image-bearing member after the transfer of the toner image to the transfer material are intactly brought to the charging-nip part with the untransferred toner by the rotation of the image-bearing member.

In this manner, the charging of the image-bearing member is effected with the electroconductive particles being present in the charging-nip part.

Owing to this presence of the electroconductive particles, the elaborate contacting property of a charging roller as a contact-charging member with the image-bearing member and the contact resistance thereof can be maintained and therefore, the direct injection charging of the image-bearing member by the charging roller can be effected. That is, the charging roller closely contacts the image-bearing member with the electroconductive particles interposed therebetween and the electroconductive particles present in the charging-nip part rub closely against the surface of the image-bearing member, whereby high charging efficiency can be obtained by stable and safe direct injection charging which does not use a discharging phenomenon, and a potential substantially equal to a voltage applied to the charging roller can be given to the image-bearing member.

Also, the untransferred residual toner on the surface of the image-bearing member after the transfer of the toner image to the transfer material is not removed by a cleaner, but comes to a developing portion via the charging-nip part with the rotation of the image-bearing member, and is cleaned (collected) simultaneously with developing by the developing apparatus. The untransferred toner arriving at the charging-nip part by the rotation of the image-bearing member, and adhering to and mixed with the charging roller is gradually discharged from the charging roller onto the image-bearing member, and comes to the developing portion with the movement of the surface of the image-bearing member, and is cleaned (collected) simultaneously with developing by the developing apparatus. A charging process thus using the electroconductive particles is suited for a cleanerless process having no exclusive cleaner, and due to the absence of the cleaner, a reduction in the diameter of the image-bearing member can also be expected and therefore, this charging process is a technique also effective to achieve a lighter weight and lower cost process cartridge.

SUMMARY OF THE INVENTION

It is an object of the present invention to provide a charging system, a process cartridge and an image-forming apparatus which enable an image-bearing member to be small in diameter.

It is another object of the present invention to provide a charging system, a process cartridge and an image-forming apparatus which are suited for charging using electroconductive particles.

It is another object of the present invention to provide a charging system, a process cartridge and an image-forming apparatus in which electroconductive particles can be brought into close contact with a member to be charged.

It is another object of the present invention to provide a charging system, a process cartridge and an image-forming apparatus which are suited for an injection-charging process.

It is another object of the present invention to provide a charging system, a process cartridge and an image-forming apparatus which are suited for a cleanerless process.

Further objects and features of the present invention will become more apparent from the following detailed description when read with reference to the accompanying drawings.

DETAILED DESCRIPTION OF THE PREFERRED EMBODIMENTS

A charging system, a process cartridge and an image-forming apparatus according to the present invention will hereinafter be described in greater detail with reference to the drawings.

<Embodiment 1>

Figure 1:
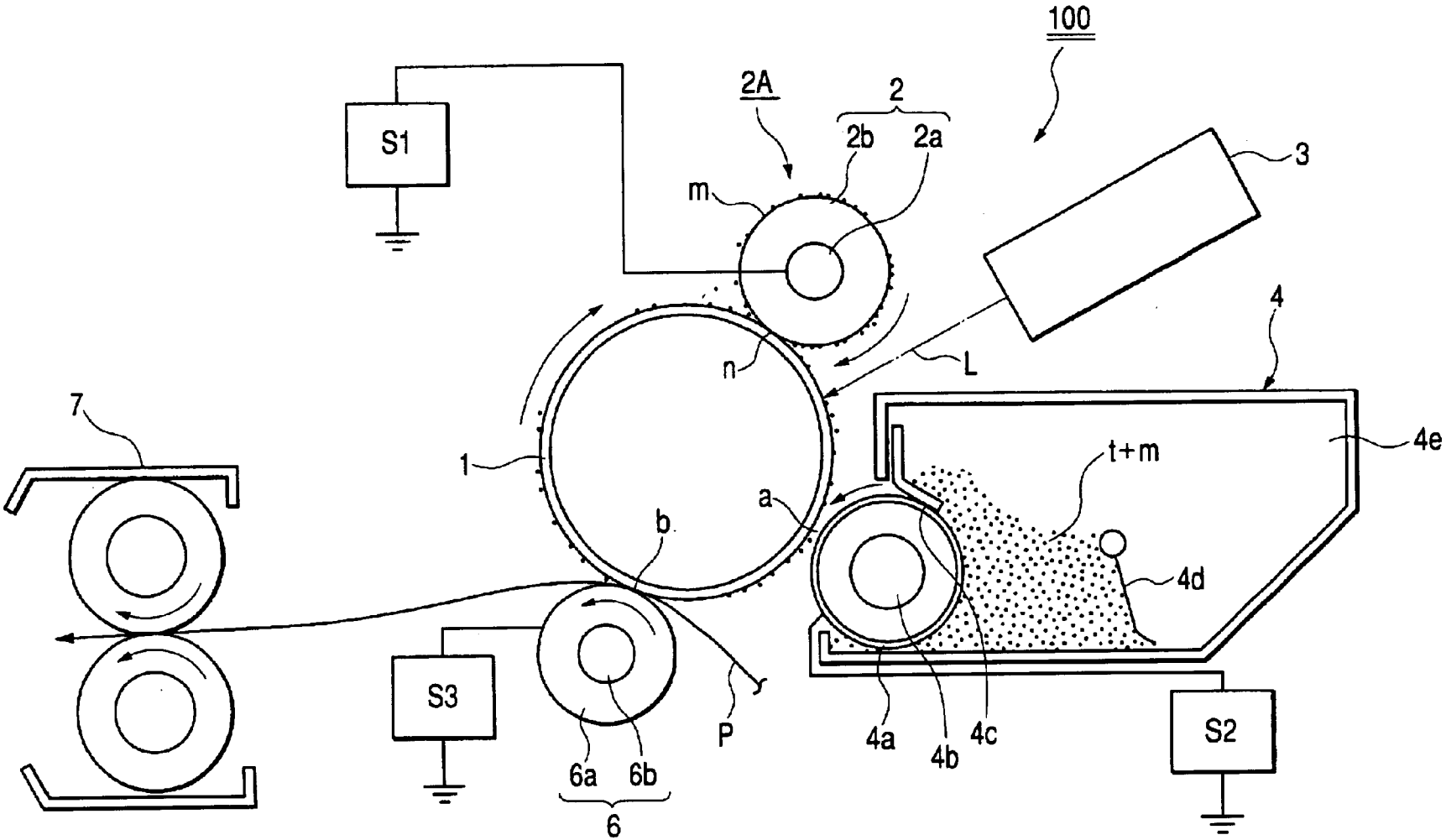
FIG. 1 is a typical cross-sectional view schematically showing the construction of an embodiment of an image-forming apparatus according to the present invention.

FIG. 1 is a model view schematically showing the construction of the image-forming apparatus 100 according to the present invention. This image-forming apparatus 100 is a laser-beam printer of a direct-injection-charging type and a toner-recycle process (cleanerless system) utilizing a transfer-type electrophotographic process.

(1) General Construction of the Image-Forming Apparatus 100

The image-forming apparatus 100, in the present embodiment, has a rotary drum-shaped, negative-polarity OPC photosensitive member (a negative photosensitive member; hereinafter referred to as the "photosensitive drum") 1 having a diameter of 24 mm as a member to be charged (image-bearing member). The photosensitive drum 1 is rotatably driven in the clockwise direction as shown by the arrow adjacent the drum 1 at a constant peripheral velocity of 86 mm/sec. (=process speed PS, printing speed). The photosensitive drum 1 will be described later in detail.

The image-forming apparatus 100 further has a charging apparatus 2A provided with a charging roller 2, which is a contact-charging member of a particle-charging type (powder-applying type), and a charging-bias-applying voltage source S1 for this charging roller 2. As described above, the image-forming apparatus 100 is provided with a charging system having the member to be charged 1 and the charging apparatus 2A.

The charging roller 2 comprises a mandrel 2*a* (metal core) as an electrode for receiving the supply of a voltage, and an elastic medium-resistance layer composed of rubber or a foamed material (hereinafter referred to as the "elastic layer") 2*b* formed into a roller shape concentrically and integrally with the outer periphery of the mandrel 2*a*, and is further comprised of electroconductive particles m borne on the outer peripheral surface of the elastic layer 2*b*. These electroconductive particles m are applied in advance to the charging roller 2 in the unused state of the charging apparatus. In the present embodiment, the outer diameter of the roller is 18 mm and the diameter of the mandrel is 6 mm. This charging roller 2 is pushed against and into contact with the photosensitive drum 1 so that the distance between the centers of the charging roller 2 and the photosensitive drum 1 may be smaller than the sum of the distance of the radius of the photosensitive drum 1 and the radius of the charging roller 2. By being pushed against the photosensitive drum 1, the difference between the sum of the distance of the radius of the photosensitive drum 1 and the radius of the charging roller 2 and the distance between the centers of the charging roller 2 and the photosensitive drum 1 is called a push-in amount herein. The charging roller 2 is pushed against the photosensitive drum 1 with a push-in amount, whereby a charging-contact part (charging-nip part) n of a predetermined width is formed between the charging roller 2 and the photosensitive drum 1. The electroconductive particles m borne on the charging roller 2 contact the surface of the photosensitive drum 1 in the charging-nip part n. The contact condition of the charging roller 2 will be described later in detail.

The charging roller 2 is rotatably driven in the same clockwise direction as the photosensitive drum 1, as seen by the arrow adjacent the charging roller 2 in FIG. 1, and is rotated in a counter direction to the direction of rotation of the photosensitive drum 1 in the charging-nip part n, to thereby contact the surface of the photosensitive drum 1 with the electroconductive particles m interposed therebetween with a speed difference. In the present embodiment, the photosensitive drum 1 and the charging roller 2 are rotatably driven in opposite directions at an equal speed (peripheral velocity) in the charging-nip part n. In the present embodiment, the charging roller 2 is rotatably driven at a peripheral velocity of 80% of the peripheral velocity of the photosensitive drum 1. The peripheral velocity will be described later in detail.

During the image-forming operation of the image-forming apparatus 100, a predetermined charging-bias voltage is applied from the charging-bias-voltage source S1 to the mandrel 2*a* of the charging roller 2. As a result, the peripheral surface of the photosensitive drum 1 is uniformly contact-charged to a predetermined polarity and potential. In the present embodiment, a charging bias of −610V was applied from the charging-bias-applying voltage source S1 to the mandrel 2*a* of the charging roller 2, whereby substantially the same charging potential (−600V) as the applied charging bias was obtained on the surface of the photosensitive drum 1.

The electroconductive particles m applied to the peripheral surface of the charging roller 2 adhere to and are taken away by the surface of the photosensitive drum 1 with the charging of the photosensitive drum 1 by the charging roller 2. Some of them are transferred to a transfer material P. Accordingly, in order to make up for them, electroconductive particle-supplying means for the charging roller 2 is required. As will be described later, in the present embodiment, a developing apparatus 4 functions as supplying means for the electroconductive particles m.

The image-forming apparatus 100 has a laser-beam scanner 3 provided with a laser diode, a polygon mirror, etc., as an exposure apparatus (optical system) for effecting image exposure. This laser-beam scanner 3 outputs a laser beam L intensity-modulated corresponding to the time-serial, electrical, digital, pixel signal of desired image information, and scans and exposes the uniformly charged surface of the photosensitive drum 1 by this laser beam L. By this scanning exposure, an electrostatic latent image corresponding to the desired image information is formed on the surface of the photosensitive drum 1.

The electrostatic latent image formed on the photosensitive drum 1 is then developed by a developing apparatus 4. In the present embodiment, the developing apparatus 4 is a reversal developing apparatus using a single-component magnetic developer (negative toner) of negative chargeability. That is, the charging polarity of the photosensitive drum and the regular charging polarity of the toner are the same polarities. A mixture agent t+m of the toner t as the developer and the electroconductive particles m is contained in the developing container (developing-apparatus main body) 4*e* of the developing apparatus 4, as will be described later in detail.

The developing apparatus 4 has as a developer bearing member comprising a developing roller 4*a* comprised of a non-magnetic, rotary developing sleeve including a magnet roll 4*b* therein. The toner t in the mixture agent t+m provided in the developing container 4*e* is subjected to layer-thickness regulation and charge impartment by a developing blade 4*c*, which is a developer-layer, thickness-regulating member, in the process of being conveyed on the developing roller 4*a*. Also, the developing apparatus 4 has an agitating member 4*d* for effecting the circulation of the mixture agent t+m in the developing container 4*e*, and sequentially conveying the mixture agent t+m to the periphery of the developing roller 4*a*.

The toner t coating the developing roller 4*a* is conveyed to a developing region (developing area) a, which is the opposed portion of the photosensitive drum 1 and the developing roller 4*a* by the rotation of the developing roller 4*a*. Also, a developing-bias voltage is applied from a developing-bias-applying voltage source S2 to the developing roller 4*a*. In the present embodiment, the developing-bias voltage is a voltage comprising a DC voltage and an AC voltage superimposed upon each other. As a result, the electrostatic latent image formed on the photosensitive drum 1 is reversal-developed by the toner t. As described above, image-forming means for forming an image on the photosensitive drum 1, which is an image-bearing member, is provided with the charging apparatus, the exposure apparatus, and the developing apparatus.

Figure 2:
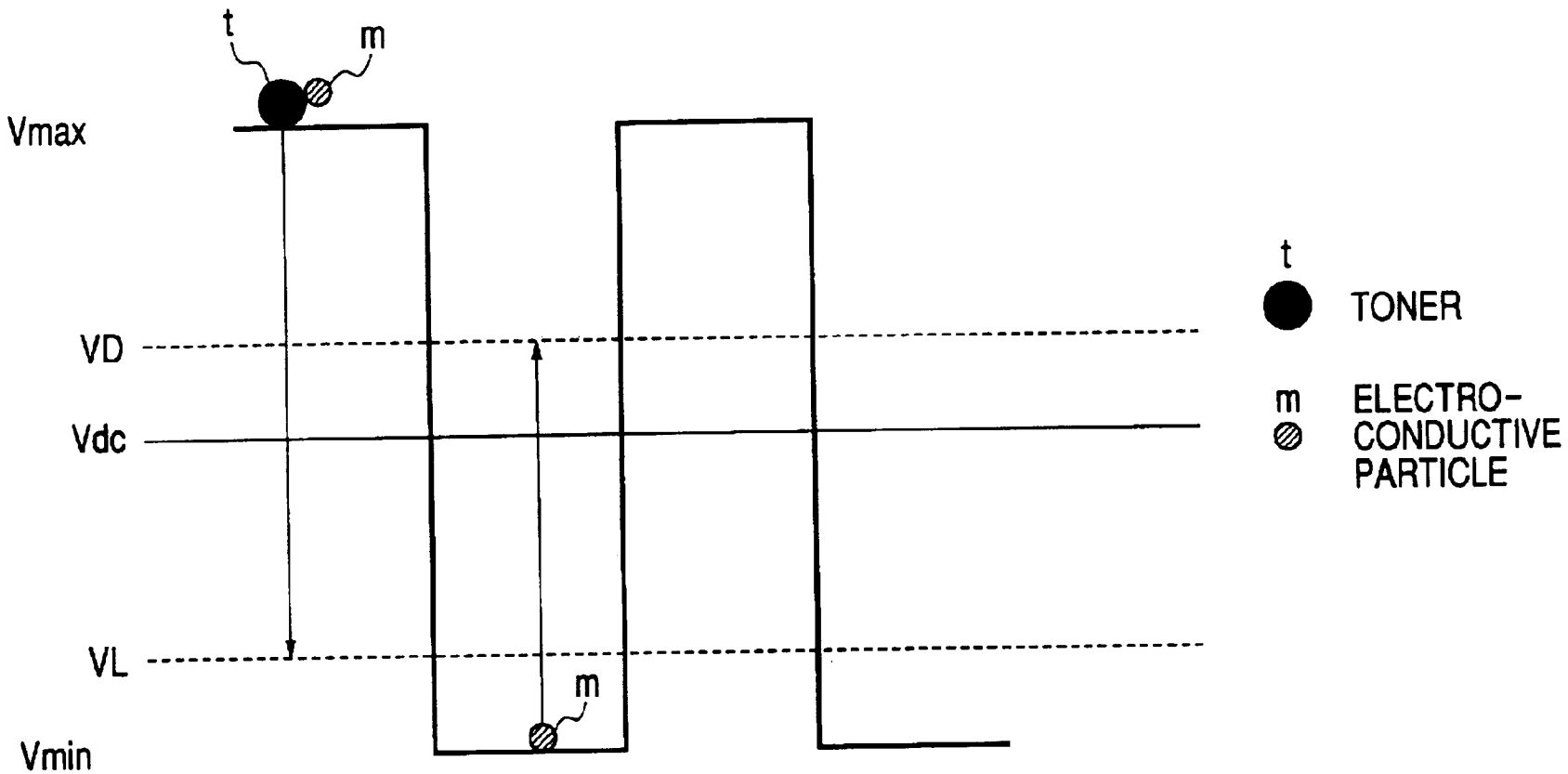
FIG. 2 is an illustration of the potential relation of the supply of electroconductive particles from a developing-sleeve side to a photosensitive-drum side.

FIG. 2 shows the relation of potential for supplying the electroconductive particles m from the developing roller 4*a* to the photosensitive drum 1. The electroconductive particles m are charged chiefly to a positive polarity by the frictional electrification with the toner. That is, the electroconductive particles m are charged to a polarity opposite to the regular charging polarity of the toner. When for example, as the developing bias, an AC voltage of 1.2 kV superimposed upon a DC voltage Vdc=−400V is applied to the developing roller 4*a*, positive particles of the electroconductive particles m separated from the toner t fly from the developing roller 4*a* to the photosensitive drum 1 with a contrast of 900V (|Vmin−VD|=|200−(−700)|) to the potential VD (−700V) of a non-image portion (exposed dark portion) by Vmin of the AC voltage.

Also, some of the electroconductive particles m adhere to the toner t, and fly from the developing roller 4*a* to the photosensitive drum 1 with a contrast of 900V (|VL−Vmax|=|−100−(−1000)|) to the potential VL of an image portion (exposed light portion) on the photosensitive drum 1 by Vmax of the AC voltage. In this manner, the supply of the electroconductive particles m from on the developing roller 4*a* to the photosensitive drum 1 is effected.

Here, the single-component magnetic developer (toner) t, which is a developer, was made by mixing binder resin, magnetic material particles and a charge-control agent and via the steps of kneading, crushing and classifying, and further with the charging particles m and a fluidizing agent or the like added as extraneous additives. In the present embodiment, the average particle diameter (D4) of the toner was 7 $\mu$m.

In the present embodiment, 2 parts by weight of electroconductive particles m are added (extraneously added) to 100 parts by weight of toner t. The electroconductive particles will be described later.

The toner image formed on the photosensitive drum 1 is then transferred to a transfer material P as a recording material by a medium-resistance transfer roller 6 as contact-transferring means. The transfer roller 6 is brought into pressure contact with the photosensitive drum 1 with a predetermined pushing force to thereby form a transferring-nip part b. The transfer material P is fed from a sheet-feeding portion (not shown) to this transferring-nip part b at a predetermined timing, and a predetermined transferring-bias voltage is applied from a transferring-bias-applying voltage source S3 to the transfer roller 6, whereby the toner image formed on the photosensitive drum 1 is sequentially transferred to the surface of the transfer material P fed to the transferring-nip part b.

The transfer roller 6 used in the present embodiment has a roller resistance value $5\times10^8$ Ω and comprises a mandrel 6*b* and a medium-resistance foamed layer 6*a* formed thereon, and a voltage of +2.0 kV was applied to the mandrel 6*b* to thereby effect transfer. The transfer material P introduced into the transferring-nip part b is nipped and transported by this transferring-nip part b, and the toner image formed and borne on the surface of the photosensitive drum 1 is sequentially transferred to the surface side of the transfer material P by an electrostatic force and a pushing force.

The transfer material P fed to the transferring-nip part b and having received the transfer of the toner image from the photosensitive drum 1 is separated from the surface of the photosensitive drum 1, and is introduced into a fixing apparatus 7, which is of a heat-fixing type in the present embodiment, and has the toner image thereon fixed and is delivered out of the image-forming apparatus as an image-formed article (a print or a copy).

The photosensitive drum 1 is then charged again by the charging roller 2 and is repetitively used for image forming.

In the present embodiment, the electroconductive particles m are added to the toner t in the developing apparatus 4, and adhere to the surface of the photosensitive drum 1 with the toner during the development of the electrostatic latent image on the photosensitive drum 1, and are carried to the charging-nip part n by the rotation of the photosensitive drum 1. That is, the electroconductive particles m are supplied to the charging roller 2 through the intermediary of the photosensitive drum 1.

That is, the image-forming apparatus 100 according to the present embodiment adopts a toner-recycle process, and the untransferred residual toner t on the surface of the photosensitive drum 1 after the image transfer is not removed by an exclusive cleaning apparatus (cleaner), but is carried to the charging-nip part n with the rotation of the photosensitive drum 1, and is temporarily collected by the charging roller 2 counter-rotated relative to the rotation of the photosensitive drum 1 in the charging-nip part n. This toner t has its reversed toner charges normalized (to a negative polarity) in the present embodiment by the frictional electrification of the toner and the electroconductive particles as it goes around the outer periphery of the charging roller 2, and is sequentially discharged to the photosensitive drum 1. That is, the toner charged to the negative polarity is repulsed by a negative voltage applied to the charging roller and therefore is discharged to the drum 1. Then, this toner t comes to the developing region a with the rotation of the photosensitive drum 1 and is collected and reused by cleaning simultaneous with developing by the developing apparatus 4. That is, it is collected by a fog-removing bias (a fog-removing potential difference V back, which is the potential difference between the DC voltage applied to the developing apparatus and the surface potential of the photosensitive member) during developing after the next step, i.e., when the photosensitive drum 1 is continued to be charged by the charging roller 2 and is exposed, to thereby form a latent image, and this latent image is developed. In the case of a reversal-developing process as in the present embodiment, this cleaning simultaneous with developing is done by the action of an electric field for collecting the toner from the dark-portion potential of the photosensitive drum 1 to the developing roller 4*a*, and an electric field for causing the toner to adhere from the developing roller 4*a* to the light-portion potential of the photosensitive drum 1.

(2) Photosensitive Drum 1

Figure 3A:
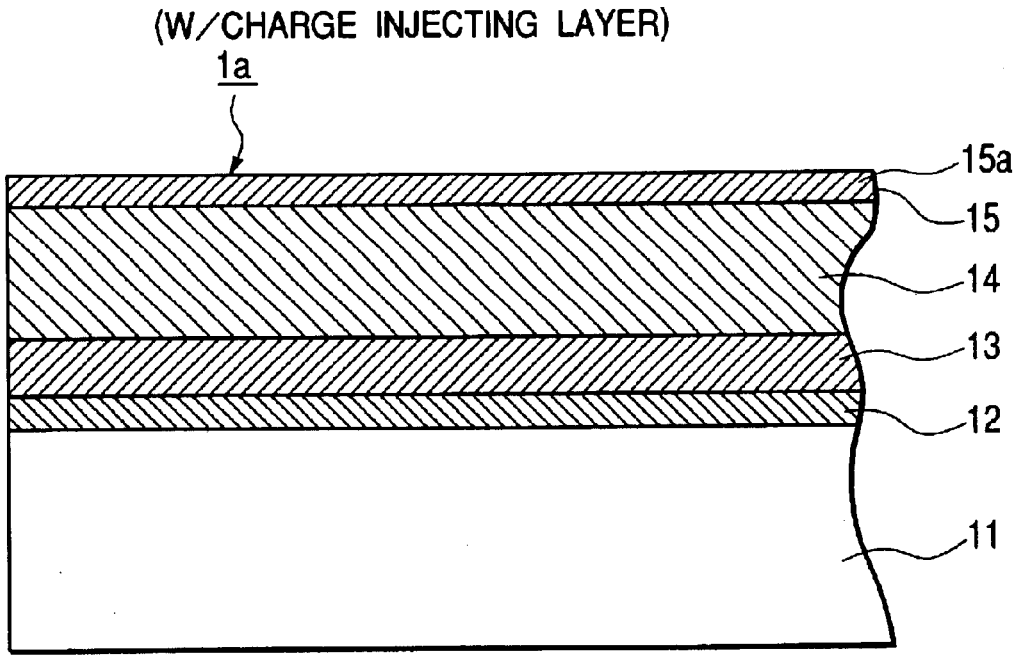
FIG. 3A is a construction model view of the layers of a photosensitive drum having a charge-injecting layer.
Figure 3B:
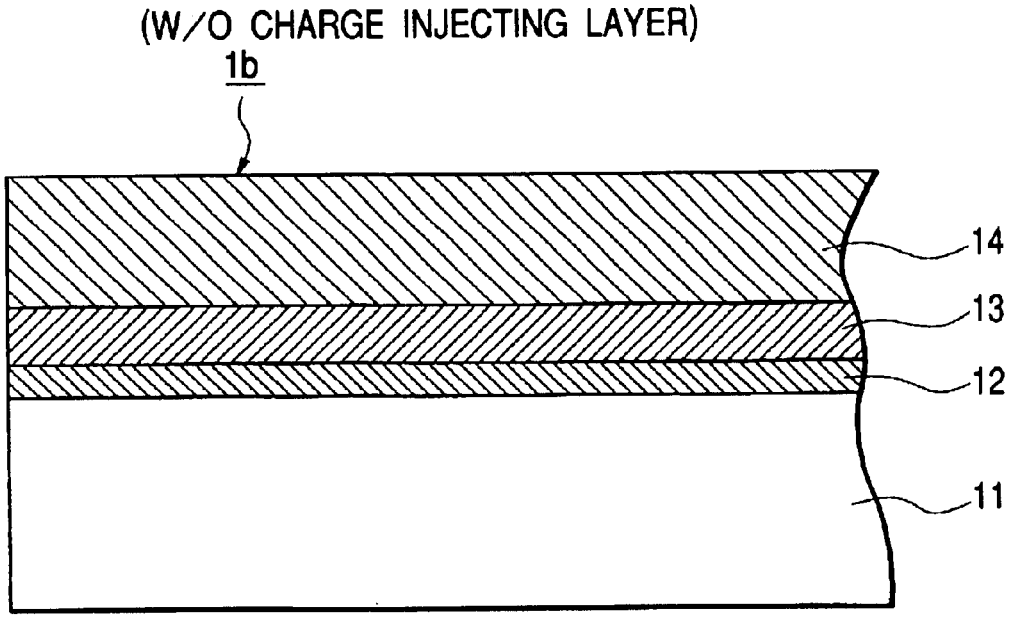
FIG. 3B is a construction model view of the layers of a photosensitive drum having no charge-injecting layer.

The photosensitive drum 1 will now be described in greater detail. FIGS. 3A and 3B are typical views of the layer constructions of photosensitive drums. FIG. 3A is a typical view of the layer construction of a photosensitive drum 1*a* with a charge-injecting layer 15, and FIG. 3B is a typical view of the layer construction of a photosensitive drum 1*b* without a charge-injecting layer.

The photosensitive drum 1*b* without a charge-injecting layer shown in FIG. 3B is a popular organic photosensitive drum comprising an aluminum drum base (Al drum base) 11 and an undercoating layer 12, a charge-producing layer 13 and a charge-transporting layer 14 applied onto the Al drum base 11 in the named order.

The photosensitive drum 1*a* with a charge-injecting layer 15 shown in FIG. 3A is improved in charging performance by the charge-injecting layer 15 being further applied to the above-described photosensitive drum 1*b* shown in FIG. 3B.

The charge-injecting layer 15 was made by mixing and dispersing $SnO_2$ ultra-fine particles 15*a* (having a diameter of about 0.03 μm) as electroconductive particles (electroconductive filter), a polymerization initiator, etc., with and in a curing-type phenol resin, and applying them as a coating, and thereafter forming them into a film by a photo-curing method.

Also, by making the charge-injecting layer include a lubricant, such as tetraethylene fluoride, in addition, there is provided the effect of suppressing the surface energy of the photosensitive drum 1 and generally suppressing the adherence of the electroconductive particles m. It is to be understood that the surface energy, when expressed by the contact angle of water, is preferably 85 degrees or greater, and more preferably 90 degrees or greater.

Also, from the viewpoint of charging performance, the resistance of the surface layer becomes an important factor. In the direct injection-charging process, it is considered that the resistance of the image-bearing-member side is lowered, whereby the area of the surface of the image-bearing member which can be charged per injecting point (contact point) becomes wider. Accordingly, even if the charging roller 2 is in the same contact state, when the resistance of the surface of the image-bearing member is low, the efficient exchange of charges becomes possible. On the other hand, as the image-bearing member, it is necessary to retain an electrostatic latent image thereon for a predetermined time and therefore, the volume resistivity value of the charge-injecting layer 15 may suitably be within the range of $1\times10^9$ to $1\times10^{14}$ (Ω·cm)

(3) Charging Roller 2

The charging roller 2 used in the present embodiment has the following characteristics.

3-1) Surface Structure and Roughness Characteristic

A certain degree of roughness is required of the charging roller 2 used as a contact-charging member in the present embodiment, from the necessity of bearing the electroconductive particles m thereon highly densely. It is preferable that the average roughness Ra be 1 μm to 500 μm. Further, to optimize the retained amount of particles and elaborately bring the particles into contact with the drum surface to thereby stabilize the uniformity of charging, 15 μm to 150

μm is optimum. In the present embodiment, the average roughness Ra of the surface of the charging roller 2 was 50 μm.

If the average roughness Ra is smaller than 1 μm, the surface area for bearing the electroconductive particles m becomes deficient, and when an insulator (e.g., the toner) or the like adheres to the surface of the charging roller 2, the periphery thereof becomes incapable of contacting the photosensitive drum 1 and the charging performance decreases. Also, when the particle-retaining capability is taken into consideration, it is preferable to have a roughness greater than the particle diameter of the electroconductive particles m used.

If, conversely, the average roughness Ra is greater than 500 μm, the unevenness of the surface of the charging roller 2 lowers the uniformity of charging in the surface of the image-bearing member.

For the measurement of the average roughness Ra, use was made of surface-shape measuring microscopes VF-7500 and VF 7510 produced by Keyence Co., Inc. and use was made of an objective lens having a magnification of 250 times to 1250 times. The measurement of the shape and Ra of the surface of the charging roller 2 was effected in a non-contact state.

3-2) Resistance Characteristic

In the direct injection-charging process, charging by a low voltage is possible and therefore, the surface layer of the contact-charging member need not be of high resistance, and the charging roller 2 can be formed by a single layer.

It is preferable that the volume resistivity of the charging roller be within the range of $10^4$ to $10^7$ Ω cm. If it is smaller than $10^4$ Ω cm, the voltage drop of the voltage source by a pinhole leak becomes liable to occur. If, on the other hand, it is greater than $10^7$ Ω cm, an electrical current necessary for charging cannot be secured and the charging voltage drops.

The volume resistivity of the charging roller 2 used in the present embodiment was $10^6$ Ω cm.

3-3) Material, Structure and Dimensions of the Charging Roller

As the material of the elastic layer 2*b* of the charging roller 2, mention may be made of EPDM, urethane, NBR or silicone rubber, or a rubber material having an electroconductive substance, such as carbon black or a metal oxide, for resistance adjustment dispersed in IR or the like. It is also possible to use an ion electroconductive material to effect resistance adjustment without dispersing an electroconductive substance. Thereafter, shaping by the roughness adjustment, polishing or the like of the surface is effected as required. A construction by a plurality of functionally separated layers is also possible.

As the form of the elastic layer 2*b* of the charging roller 2, a however, porous material (foamed material) structure is preferable. This is also advantageous in manufacturing in that the aforedescribed surface roughness can be obtained simultaneously with the molding of the roller. As the cell diameter of the foamed material, 1 to 500 μm is appropriate. Further, 30 to 300 μm is desirable. After the porous material is foam-molded, the surface thereof is polished to thereby expose the surface of the porous material, and the surface structure having the aforementioned roughness can be made. In the present embodiment, the cell diameter was 150 μm.

Finally, an elastic layer 2*b* of a layer thickness 6 mm having a porous material surface was formed on a mandrel 2*a* having a diameter of 6 mm and a length 240 mm, to thereby make a charging roller 2 having a length of 220 mm and an elastic layer 2*b* of a layer thickness 6 mm.

3-4) Other Roller Characteristics

In the direct injection-charging process, it is important for the contact-charging member to function as a flexible electrode. In the present embodiment, this is achieved by adjusting the elastic characteristic of the elastic layer 2*b* of the charging roller 2. 15 to 50 degrees in terms of Asker C hardness is a preferable range. In the present embodiment, 15 to 40 degrees was preferable in securing the nip by appropriate contact pressure.

If the hardness is too high, unless the pushing force is made great, a necessary push-in amount cannot be obtained, and the charging-nip part n cannot be secured between the charging roller and the image-bearing member and therefore, the charging performance decreases.

If, on the other hand, the hardness is too low, the shape is not stable and therefore, unevenness occurs to the contact pressure of the charging roller with the image-bearing member, and uneven charging occurs. Or faulty charging by the permanent distortion of the charging roller 2, due to its being left as it is for a long period, is caused.

3-5) Contact Construction of the Roller with the Drum

Figure 4A:
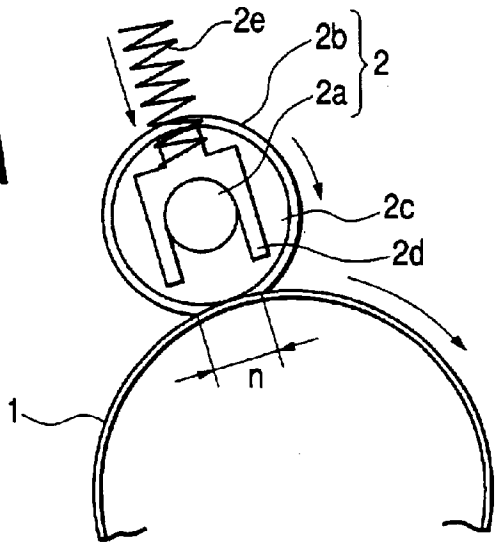
FIG. 4A is a side view showing the construction of the contact between a charging roller 2 and a photosensitive drum 1.
Figure 4B:
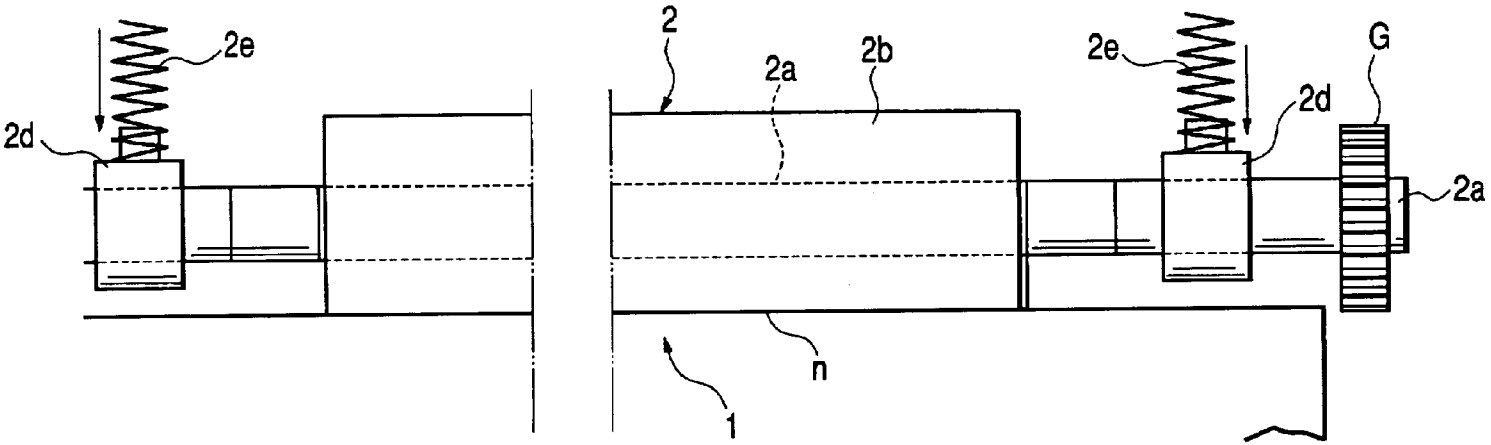
FIG. 4B is a front view showing the construction of the contact between the charging roller 2 and the photosensitive drum 1.

FIG. 4A shows a side view of the contact construction between the charging roller 2 and the photosensitive drum 1, and FIG. 4B shows a front view of the contact construction between the charging roller 2 and the photosensitive drum 1 in which an intermediate portion is omitted.

The charging roller 2 has the opposite end portions of its mandrel 2*a* rotatably journalled to fork-shaped bearings 2*d* and arranged in parallel to the photosensitive drum 1, and has the fork-shaped bearings 2*d* on its opposite ends pressed toward the photosensitive drum by pressure springs 2*e*, whereby it is held in pressure contact with the photosensitive drum 1.

The push-in amount of the charging roller 2 to the photosensitive drum 1, if the diameters of the photosensitive drum and the charging roller are constant, is determined from the relation between the pressure of the pressure springs and the hardness of the charging roller, and the contact-charging part n of a predetermined width is formed. In the present embodiment, a spring-pressure force of 4.9 to 9.8 N (500 to 1000 gf) and pressure of $f=2.2\times10^{-2}$ to $4.4\times10^{-2}$ N/mm (2.25 to 4.5 g/mm) per unit length of the charging roller were suitable. When the hardness of the charging roller was 15 to 40°, the nip width could be set to about 2 to 4 mm.

The fork-shaped bearings 2*d* on the opposite end portions are fitted in guide grooves formed in apparatus side plates, not shown, and are slidable toward the photosensitive drum 1. The letter G designates a drive gear secured to one end of the mandrel 2*a* of the charging roller 2, and a rotational force is transmitted from a driving system, not shown, to this drive gear G, whereby the rotational driving of the charging roller 2 is performed.

(4) Electroconductive Particles m

In the present embodiment, as the electroconductive particles m, use was made of electroconductive zinc oxide having a specific resistance of $10^6$ Ω·cm and an average particle diameter of 2 μm. These electroconductive particles m, in the present embodiment, are contained in the developing apparatus 4.

As the material of the electroconductive particles m, use can be made of various electroconductive particles, such as electroconductive inorganic particles like other metal oxide, a mixture with an organic substance, or these substances subjected to surface treatment. For example, titanium oxide particles doped with alumina powder and tin oxide can be suitably used.

The resistance of the electroconductive particles m, in order to effect the exchange of charges through the particles, needs to be $10^{12}$ Ω·cm or less as the specific resistance, and desirably $10^{10}$ Ω·cm or less. The resistance of the electroconductive particles m, when the leak of the developing bias during development is taken into consideration, is $10^{-1}$ Ω·cm or greater as the specific resistance.

The measurement of the resistance was performed by the pellet method, and was normalized to find the value thereof. That is, about 0.5 g of electroconductive particles m was put into a cylinder having a bottom-surface area of 2.26 $cm^2$, and a pressure of 147 N (15 kgf) was applied to upper and lower electrodes and at the same time, a voltage of 100V was applied thereto and a resistance value was measured, whereafter it was normalized to thereby calculate the specific resistance.

Also, the particle diameter of the electroconductive particles m should desirably be 10 μm or less, in order to obtain high charging efficiency exceeding that of a magnetic brush charging apparatus, and the uniformity of charging. Here, the particle diameter, when the particles constituted an aggregation, was defined as the average particle diameter as the aggregation. For the measurement of the particle diameter, 100 or more particles were extracted from observation through an electronic microscope, and a volume-particle-diameter distribution was calculated with a maximum extension in a horizontal direction, and the particle diameter was determined by the average particle diameter of 50% thereof.

The electroconductive particles m will pose no problem even if they exist not only in the state of primary particles, but also in the aggregating state of secondary particles. In whatever aggregating state they may be, the form thereof is not important if the function as the electroconductive particles m can be realized as an aggregation.

The electroconductive particles m should desirably be white or nearly transparent so as not to hinder the exposure of the latent image particularly when they are used for the charging of the photosensitive drum 1. That is, the electroconductive particles should desirably be non-magnetic. Also, considering that the electroconductive particles m are partly transferred from the photosensitive drum 1 to the transfer material P, it is desirable in color image forming that the electroconductive particles be achromatic or white. Further, in order to prevent the scattering of light by the electroconductive particles m during image exposure, the particle diameter thereof should desirably be equal to or smaller than a constituent pixel size, and further equal to or smaller than the particle diameter of the toner t.

As the lower limit value of the particle diameter, 10 nm is considered to be the limit as what is stably obtained as the particles. That is, the particle diameter of the electroconductive particles m should preferably be within the range of 10 nm to 10 μm. Furthermore, considering the characteristic of fog on a transferring material, it should be within the range of 0.1 μm to 5 μm.

As the result of having variously changed and studied the particle diameter of the electroconductive particles m, when use was made of zinc oxide particles having a particle diameter of 0.01 μm, which are popular electroconductive particles m, they were somewhat disadvantageous because of faulty development and fog, but exhibited sufficient charging performance. On the other hand, when use was made of zinc oxide particles exceeding a particle diameter of 10 μm, these particles were disadvantageous with respect to contact density because of the large particle diameter, and were insufficient (bad) also with respect to charging performance. Further, when use was made of zinc oxide particles having a particle diameter of 30 μm, the particle diameter is large and the force with which the particles adhere to the charging roller is weak and therefore, many particles came off, and faulty development and fog occurred.

(5) The Borne Amount of Electroconductive Particles

By making the particle diameter of the electroconductive particles m in particle charging small, the charging performance is improved, but the coming-off of the electroconductive particles m to the photosensitive drum 1 becomes remarkable. The force which can retain the electroconductive particles m on the charging roller 2 is a weak adhering force and therefore, even if many particles are supplied, it is difficult to restrain the particles, and the particles come off to the photosensitive drum 1 and tend to cause a defective image to be produced at the developing step and to be transferred to the transfer material at the transferring step thereafter. Accordingly, ideally, it is desirable to apply the electroconductive particles more uniformly to the surface layer of the charging roller 2. Actually, however, by adjusting the borne amount, it becomes possible to secure the charging property and also, to decrease adhering particles to a level that is free of image defects.

It is necessary to keep the borne amount of the electroconductive particles m appropriate by the average roughness Ra of the surface of the charging roller 2. That is, the design of the apparatus is made such that a value obtained by dividing the borne amount by the average roughness Ra (hereinafter simply referred to as "the borne amount/Ra) is 1 $mg/cm^2/\mu m$ or less, and preferably is 0.3 $mg/cm^2/\mu m$ or less. Also, in order to effect good injecting charging, it is preferable that the borne amount be 0.005 $mg/cm^2/\mu m$ or greater.

In the present embodiment, the borne amount of the electroconductive particles m was about 3 $mg/cm^2$, Ra was 50 μm, and the borne amount/Ra was 0.06 $mg/cm^2/\mu m$.

(6) The Borne Amount of Particles and Resistance Measurement

The particles borne on the charging roller 2 were washed, and the weight and the resistance of the particles were measured. A washing liquid comprising ethanol and water (1:2) was prepared in an ultrasonic washing machine, and the charging roller 2 was dipped therein and washed. Washing is repetitively effected while the surface of the charging roller 2 is confirmed through an optical microscope or the like and while the surface of the charging roller 2 is rubbed against by a blade or the like as required, whereby an adhering substance on the charging roller 2 can be removed.

The thus obtained washing liquid is left stationary for 1 to 2 hours, and when it can be apparently separated from the top thereof, the top is removed. Thereafter, it was sufficiently dried at 105° C. and the borne substance on the charging roller 2 was extracted.

The measurement of particle resistance follows the aforedescribed pellet method.

The borne amount is found as a borne amount per unit area from the total weight of the obtained particles and the surface area of the charging roller 2 (calculated from the length and outer diameter of the charging roller 2).

(7) Covering Rate of the Electroconductive Particles

Further, in order to grasp the presence of the actually effective amount of the electroconductive particles m in charging, it becomes more important to adjust the covering rate of the electroconductive particles m. When, for example, electroconductive zinc oxide is used as the electroconductive particles m, the electroconductive particles m, which are white, can be distinguished from the color of the toner (in the present embodiment, the magnetic toner is black). In an observation through a microscope, the area presenting as white is found as the area rate. When the covering rate is 0.1 or less, the charging performance of the charging roller 2 is insufficient even if the peripheral velocity of the charging roller 2 is heightened and therefore, it becomes important to keep the covering rate of the electroconductive particles m within the range of 0.2 to 1.

The adjustment of the borne amount can basically be effected by adjusting the added amount of the electroconductive particles m to the toner t.

(8) Measurement of the Covering Rate

Regarding the measurement of the covering rate, a microscopic observation was made in a state approximate to the contact condition of the charging roller 2, to thereby measure an area covered with the electroconductive particles m. Specifically, the rotation of the photosensitive drum 1 and the charging roller 2 was stopped with the charging bias not applied, and the surfaces of the photosensitive drum 1 and the charging roller 2 were photographed by a video microscope (Model 0V M1000N produced by OLYMPUS) and a digital still recorder (Model SR-3100 produced by DELTS). As to the charging roller 2, it was brought into contact with slide glass under the same condition as when the charging roller 2 is brought into contact with the photosensitive drum 1, and the contact surface thereof was photographed from the back of the slide glass by the video microscope with the aid of an objective lens having a magnification of 1,000 times. Thereafter, the area covered with the particles was separated with the color or brightness of the electroconductive particles m measured beforehand, and the area rate was found and was determined as the covering rate. Also, when the discrimination by color was difficult, the measurement of the substance of the outermost surface of the charging roller 2 was carried out by a fluorescent X-ray analyzing apparatus, SYSTEM 3080 (produced by Rigaku Industrial Co., Ltd.). First, in an initial state, a polyester tape (No. 550 (#25) produced by Nichiban) is nipped between the charging roller 2 covered with the electroconductive particles m and the photosensitive drum 1 with the adhesive surface thereof turned to the charging roller 2, and the photosensitive drum 1 and the charging roller 2 are driven to rotate, and the polyester tape is once passed through the charging-nip part n between the charging roller 2 and the photosensitive drum 1. At this time, on the surface of the tape, the particles on the outermost surface of the charging roller 2 are sampled as a layer. On the other hand, sampling is likewise effected on the charging roller 2 whose printing test has been finished. By quantifying the content of a particular element contained in the electroconductive particles m, it is possible to find the covering rate. That is, with the tape sample for the charging roller 2 bearing only the electroconductive particles m thereon producing a value of 1, it becomes possible to calculate the rate of the sample after the printing test, and to find the covering rate.

(9) About the Charging Roller, the Drum Diameter and the Charging Property

A description will now be provided of the charging roller, the drum diameter and the charging property in the present invention. In the present invention, the relation between such a charging-roller diameter and the drum diameter as can secure a predetermined amount or more of the relation of the nip to the push-in amount is prescribed.

9-1) About a Smaller Drum Diameter and Disposition

An object of the present invention is to make the diameter of the drum smaller for the curtailment of cost and the downsizing of the image-forming apparatus. When the diameter of the drum is defined as LD (mm), $LD \leqq 25$ (mm).

Also, as regards the drum diameter LD (mm) and the charging roller diameter LC (mm), $LC \leqq LD$ is more preferable in widening the degree of freedom of the disposition of developing, exposure and transfer elements. Also, it is desirable that the drum diameter be 15 mm or larger.

9-2) About the Charging Property

As previously described, in the direct injection-charging mechanism by particle charging (power-applying type), the contacting property of the contact-charging member with the image-bearing member affects the charging property, and it is good for improvement in the uniformity of charging to enhance the uniformity and closeness of the contact of the contact-charging member with the image-bearing member, and to make the peripheral velocity ratio of the charging member great in order to make the contact opportunity great. It is necessary to maintain the borne amount and covering rate of the electroconductive particles on the contact-charging member so as to be within a preset proper range. Also, the charging property of direct injection charging is related to the ratio between the peripheral velocity of the photosensitive drum 1 and the peripheral velocity of the charging roller 2, and a greater peripheral velocity ratio is preferable because it makes the contact opportunity great. The charging property of the direct injection charging is correlated with the product of the contact-nip width and the peripheral-velocity ratio.

To enhance the uniformity and closeness of the contact of the contact-charging member with the image-bearing member, it is advantageous to make the nip great. The nip is related to the diameter of the charging roller, the diameter of the drum, and the push-in amount of the charging roller, and larger diameters of the charging roller and the drum result in a smaller push-in amount, but are advantageous to secure the nip greatly.

Also, the push-in amount is related to the contact pressure and the roller hardness of the charging roller, and as the contact pressure is greater and the roller hardness is lower, the nip becomes greater. However, if the contact pressure is made greater, the driving torque of the charging roller becomes greater, and if the roller hardness is made lower, the uniformity of the nip is aggravated and the setting property of the charging roller is aggravated. This setting is liable to occur particularly when the charging roller is provided with a foamed material, and if the charging roller and the drum are left in their stopped state, the trace of a nip shape corresponding to the charging nip is produced on the surface of the charging roller because the charging roller is softer than the drum. If the trace of the nip is produced, the contact state between the charging roller and the drum becomes poor and thus, the injecting charging characteristic is lowered.

To bring the roller surface into close contact with the drum, it is preferable that the push-in amount be made greater than the roller-surface roughness Ra. It is preferable that the surface roughness Ra (mm) of the charging roller and the push-in amount $\delta$ (mm) thereof relative to the image-bearing member be in the relation that $Ra \leqq \delta$.

In the case of the present embodiment, the surface roughness Ra (mm) of the charging roller is Ra (mm)=0.05 and therefore, it is preferable that the push-in amount $\delta$ (mm) thereof relative to the image-bearing member be made equal to or greater than 0.05.

It is preferable that the push-in amount be made equal to or greater than the surface roughness Ra of the roller and the nip width be set to 2 mm or greater.

Figure 5:
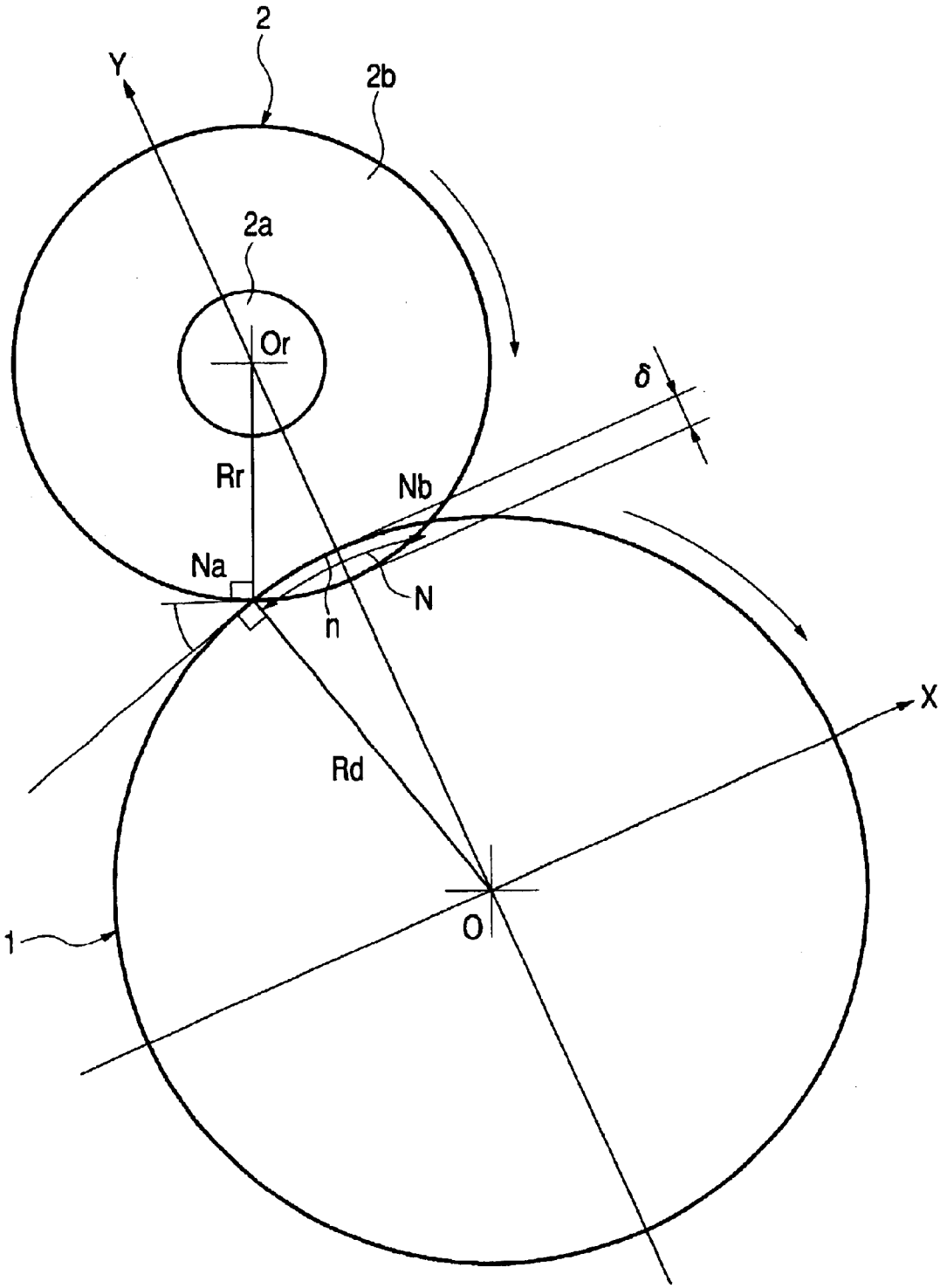
FIG. 5 illustrates the relations among a drum diameter, the diameter of the charging roller, a push-in amount and a nip.

9-3) Relation Among the Photosensitive-Drum Diameter, the Charging-Roller Diameter and the Push-in Amount, the Nip Width FIG. 5 shows the relation among the nip width N, the drum radius Rd, the roller radius Rr and the push-in amount δ in the charging-contact part n.

With the center O of the photosensitive drum 1 as the origin, a normal direction linking the center O of the photosensitive drum and the center Or of the charging roller together is defined as the Y-axis. On the other hand, a line perpendicular to the Y axis containing the center O of the photosensitive drum is defined as the X-axis. Further, when the coordinates of the opposite ends Na and Nb of the contact portion n are defined as (Xn, Yn), they are represented by $Xn^2+Yn^2\ Rd^2$ $Xn^2+(Yn-Rr-Rd+\delta)^2=Rr^2$.

The coordinates of Na and Nb were found from the above expressions, and the push-in amount and the nip width $N=2\times|Xn|$ were found.

The actually measured result could be made to correspond to the calculated values. A method of actually measuring the push-in amount is to measure the outer diameter of the charging roller and the diameter of the mandrel thereof, and then measure the gap between the mandrel and the drum surface in a state in which the charging roller has been put together with the drum, by a laser-length measuring machine. The push-in amount was found from those values.

When the drum diameter and the charging-roller diameter are selected, the relation between the push-in amount δ and the nip width N can be found. When the drum diameter is to be made small, to suppress the push-in amount and secure the nip, it is necessary to make the charging-roller diameter large, and a necessary relation therefor was examined.

Figure 6:
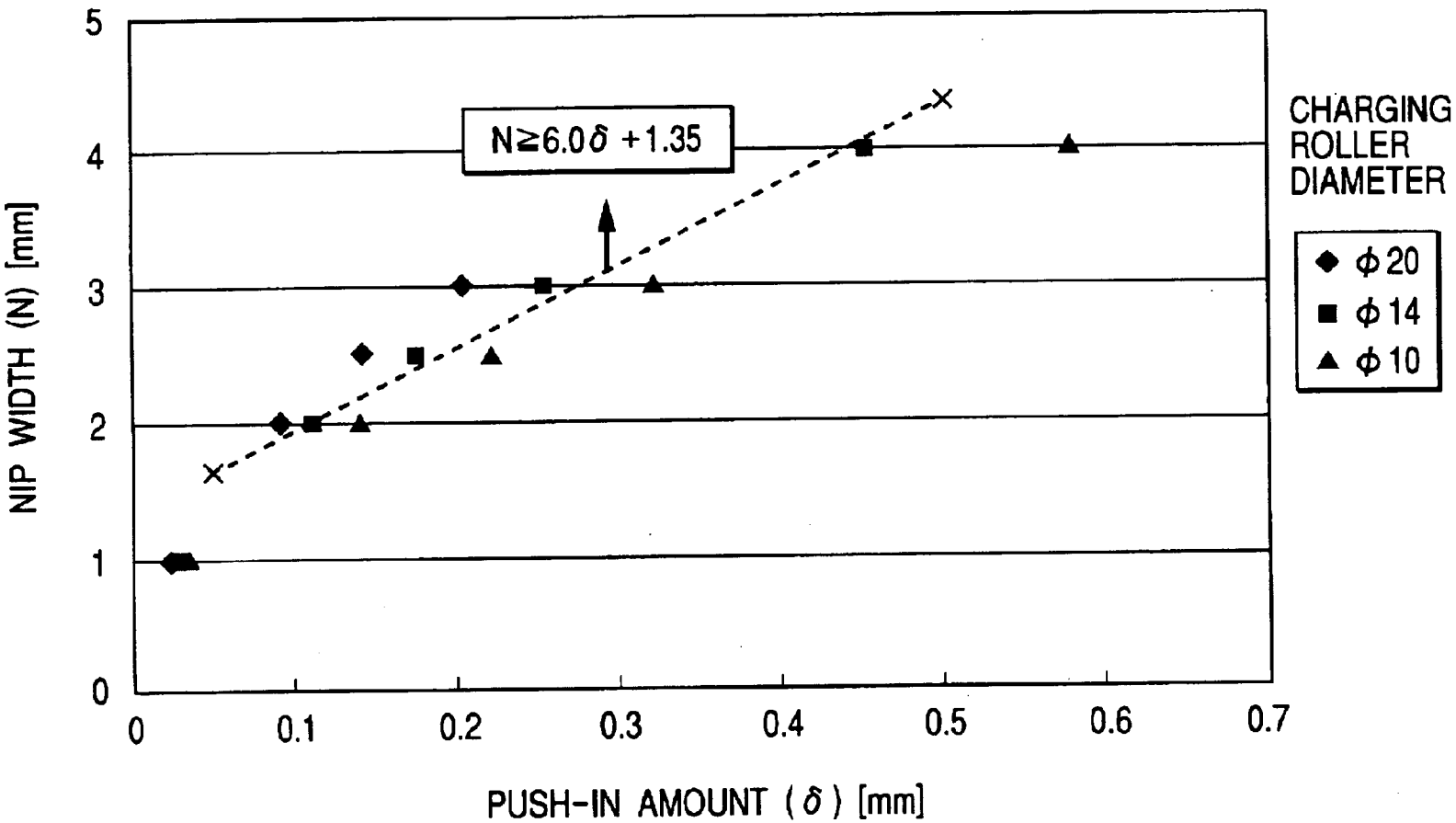
FIG. 6 shows a nip width and the push-in amount.

FIG. 6 shows the relations between the push-in amount and the nip width when the charging-roller diameter (LC) was selected to 10 (mm), 14 (mm) and 20 (mm) when the drum diameter (LD) is 25 (mm). Assuming now that $N\geqq 6.0\delta+1.35$, δ can be selected to about 0.1 mm for the nip of 2 mm. Also, even when the nip width is 4 mm, the push-in amount δ can be suppressed to 0.45 mm, and this is very effective to stably secure the nip. The nip width is optionally within the range of 1 to 4 mm, and is preferably within the range of 2 to 4 mm and therefore, when δ is 0.1 mm or greater, it is very preferable to satisfy $N\geqq 6.0\delta+1.35$.

When the drum diameter (LD) is 25 (mm), this relation is satisfied when the charging-roller diameter is made equal to or greater than 14.

Figure 7:
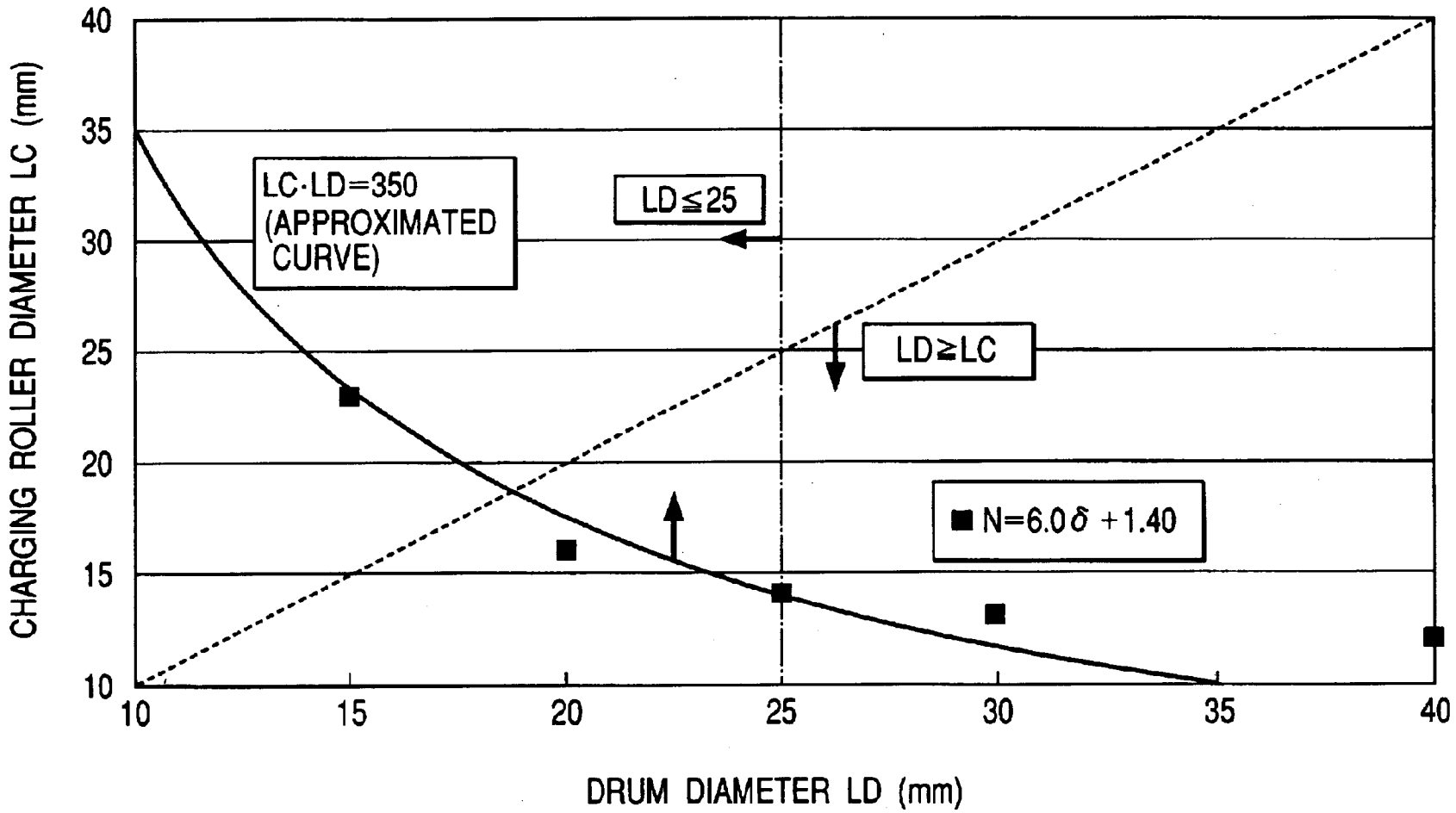
FIG. 7 shows the proper ranges of the drum diameter and the diameter of the charging roller.

FIG. 7 shows the drum and charging-roller diameter satisfying this relation, which were found by calculation. It is difficult to express this relation as an approximated function, but within the drum-diameter range of 15 to 25 mm, a rough approximation can be performed by the expression $LD\times LC\geqq 350$, which is a relation of inverse proportion.

That is, even when the drum diameter is made equal to or less than 25 mm, if the relation between the drum diameter and the charging-roller diameter is specified by $LD\times LC\geqq 350$, it is possible to suppress the push-in amount of the charging roller and yet secure the charging nip.

(10) About the Setting Property of the Charging Roller

The charging roller is an elastic foamed member and is in deformation-contact with the drum and therefore, may be set-deformed and cause faulty charging, as already described.

Figure 8:
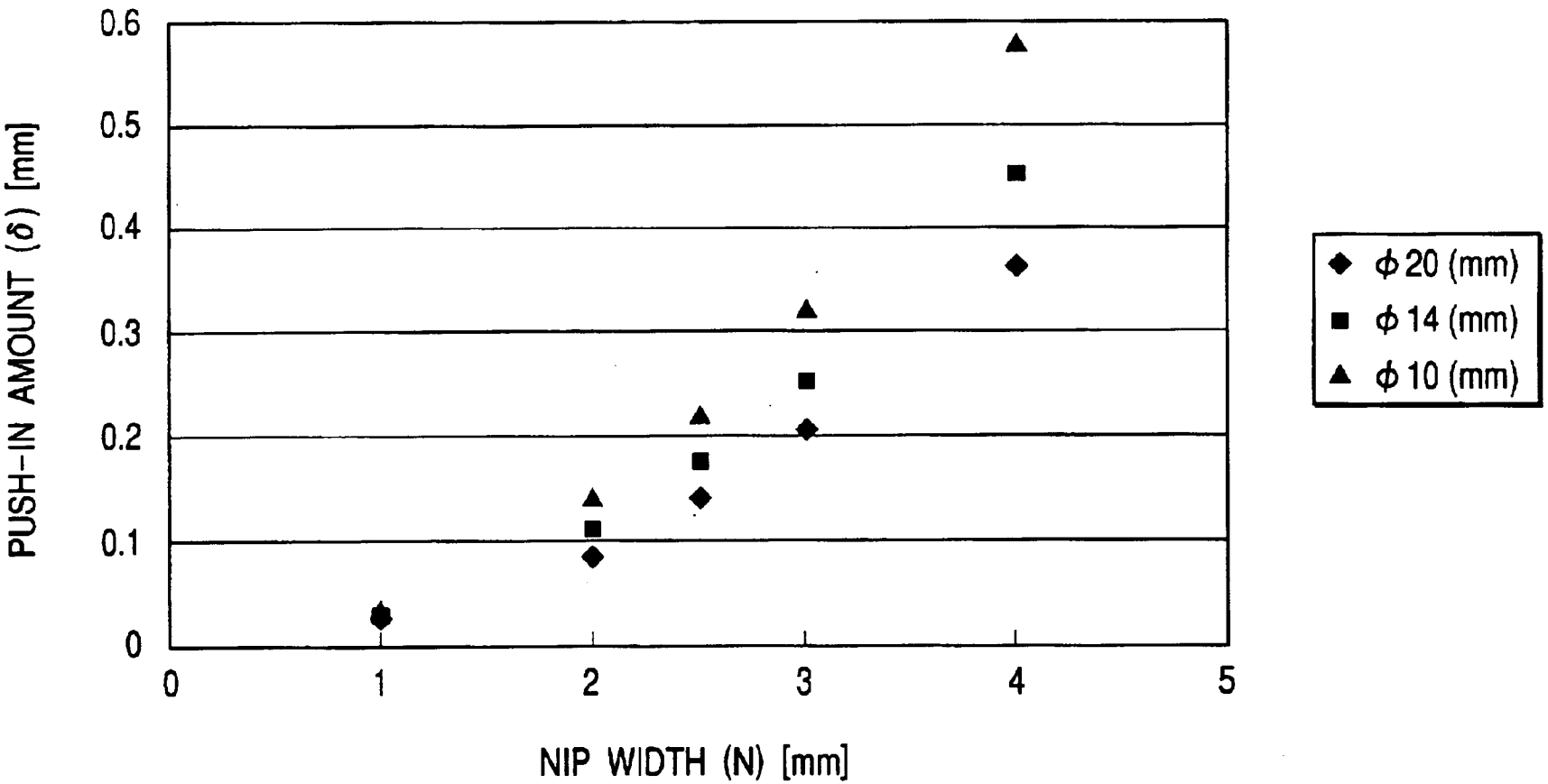
FIG. 8 shows the result of the examination of the relation between the nip width and the push-in amount.

A description will hereinafter be provided of the substance of studies made under a condition and examining a construction for reducing the influence of setting. FIG. 8 shows a result obtained by examining the relation between the push-in amount (mm) and the nip width (mm) with the charging-roller diameter as a parameter.

It will be seen that as previously described, it can make the push-in amount smaller relative to the nip to make the charging-roller diameter large.

Figure 9:
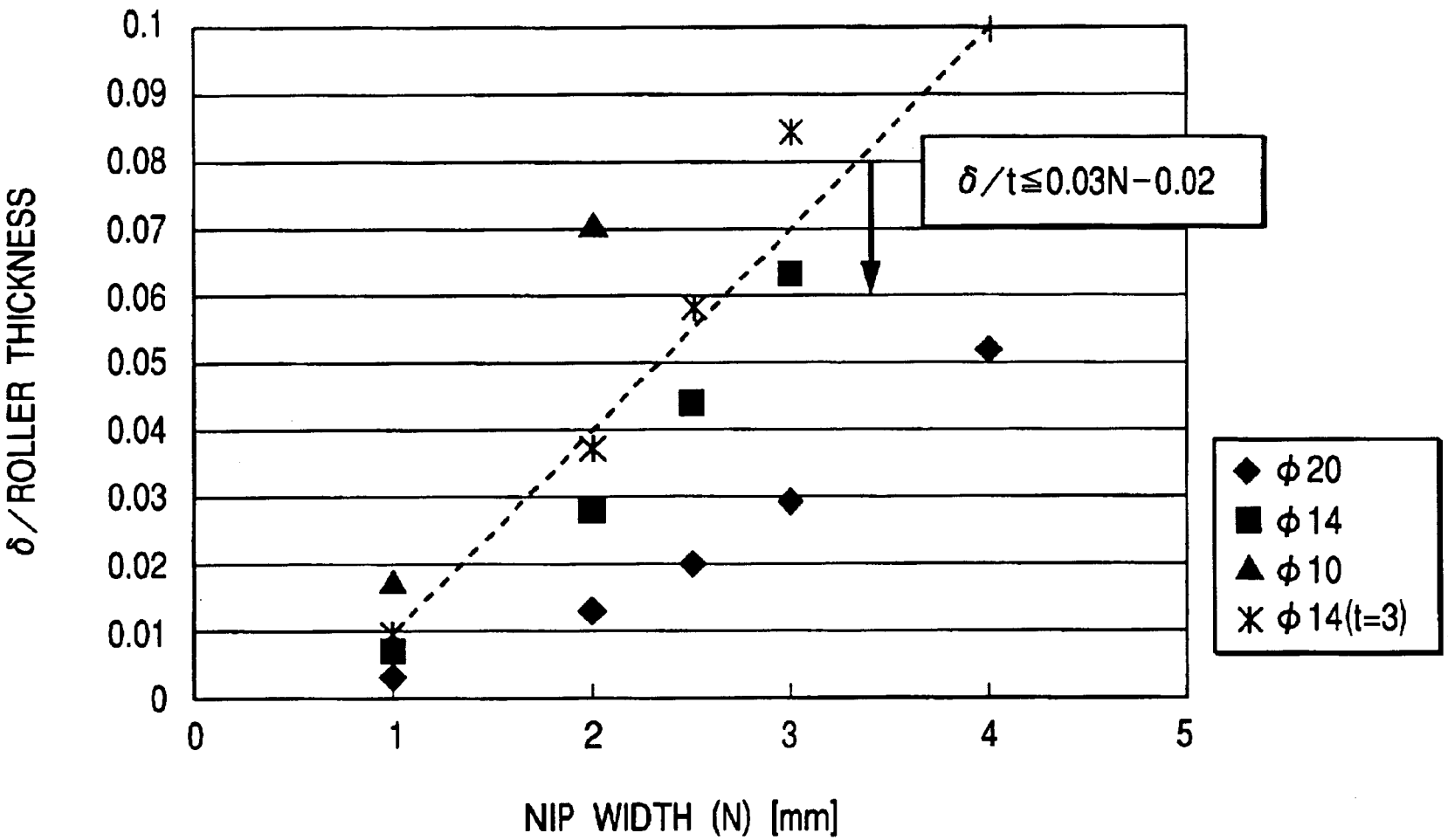
FIG. 9 shows the nip width and the push-in amount roller thickness.

Further, FIG. 9 shows the relation between the nip width and the push-in amount δ (mm)/the thickness t (mm) of the roller, when the thickness of the elastic material of the charging roller is t (mm). In FIG. 9, there is shown a result obtained under the following conditions:

roller outer diameter 20 mm, roller mandrel diameter 6 (thickness of elastic material of roller t=7)

roller outer diameter 14 mm, roller mandrel diameter 6 (thickness of elastic material of roller t=4)

roller outer diameter 10 mm, roller mandrel diameter 6 (thickness of elastic material of roller t=3)

roller outer diameter 14 mm, roller mandrel diameter 8 (thickness of elastic material or roller t=3)

By making the roller diameter large, δ/t can be made small. When the thickness of the elastic material of the roller is made great, δ/t can be made still smaller. The smaller is δ/t, the better becomes the returning property when the contact state has been released.

(11) Evaluation Items and Method

The charging roller brought into contact with the drum was left under a high-temperature, high-humidity environment for a month. Thereafter, image forming was effected and the occurrence of faulty charging of the charging-roller contact portion in the roller-contact portion was examined.

A laser scanner of 600 dpi was used as the exposure apparatus 3 and image recording was effected. In this evaluation, one line in a main scanning direction with respect to a halftone image was recorded, whereafter two patterns, i.e., a lateral design pattern in which two lines were non-recorded and a pattern of dot positions to which a knight can move in chess, were sampled.

Here, image recording is effected by a reversal-developing system and therefore, when the setting is bad, density becomes high or faulty charging in the shape of a black spot on a white background appears in an image.

○: none

Δ: a faint lateral band which can be seen only in a halftone image x: faulty charging found even in a white portion When the setting of the charging roller was examined under the condition of the above-mentioned parameter, what is below a dotted line indicated in FIG. 9 ($\delta/t\leqq 0.03N-0.02$) was OK.

That is, it has been found that when the thickness of the elastic material of the charging roller is t (mm), and the area in which the nip N (mm) and the push-in amount δ (mm)/the elastic-material roller thickness t (mm) are given by:

$0.01\leqq\delta/t\leqq 0.03N-0.02$ and $1\leqq N\leqq 4$, a lateral band or a black spot on a white background does not appear in an image.

$0.01\leqq\delta/t$ is a condition under which stable contact is possible. In order to satisfy this condition, it is preferable that the elastic-material roller thickness be 4 mm or greater.

In the case of injection charging, it is considered that in the portion in which the charging member is in contact with the drum, the charging member is charged in the entire nip area and therefore, if the nip is great, it is advantageous to even the deformation of the roller. By making the roller diameter large, it is possible to make δ/t small. If the elastic-material roller thickness is made great, δ/t can be made still smaller. The smaller is δ/t, the better becomes the returning property when the contact state no longer occurs, whereby the effect for the setting of the charging roller is great.

As described above, according to the present embodiment, it is possible to achieve a smaller diameter of the image-bearing member using the direct injection-charging mechanism by particle charging (powder-applying type). Particularly, when use is made of an image-bearing member having a diameter of 25 mm or less, the charging property of direct injection charging can be improved. Another effect is that a reduction in the setting of the charging member for direct injection charging can be achieved.

<Embodiment 2>

A description will now be provided of an embodiment in which the present invention has been embodied in an electrophotographic image-forming apparatus on which a process cartridge is made detachably mountable.

Figure 10:
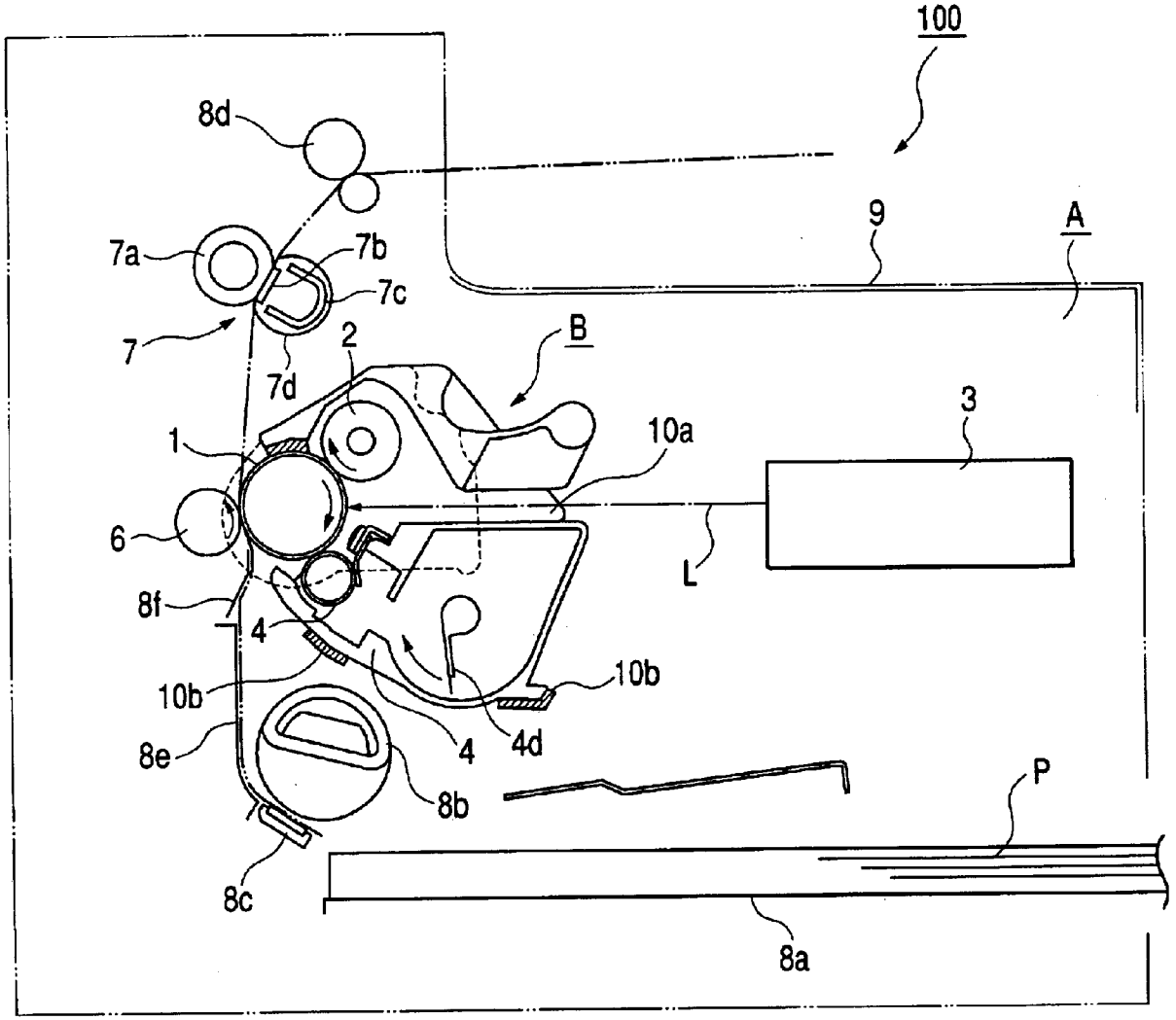
FIG. 10 is a schematic cross-sectional view of another embodiment of the image-forming apparatus according to the present invention.
Figure 11:
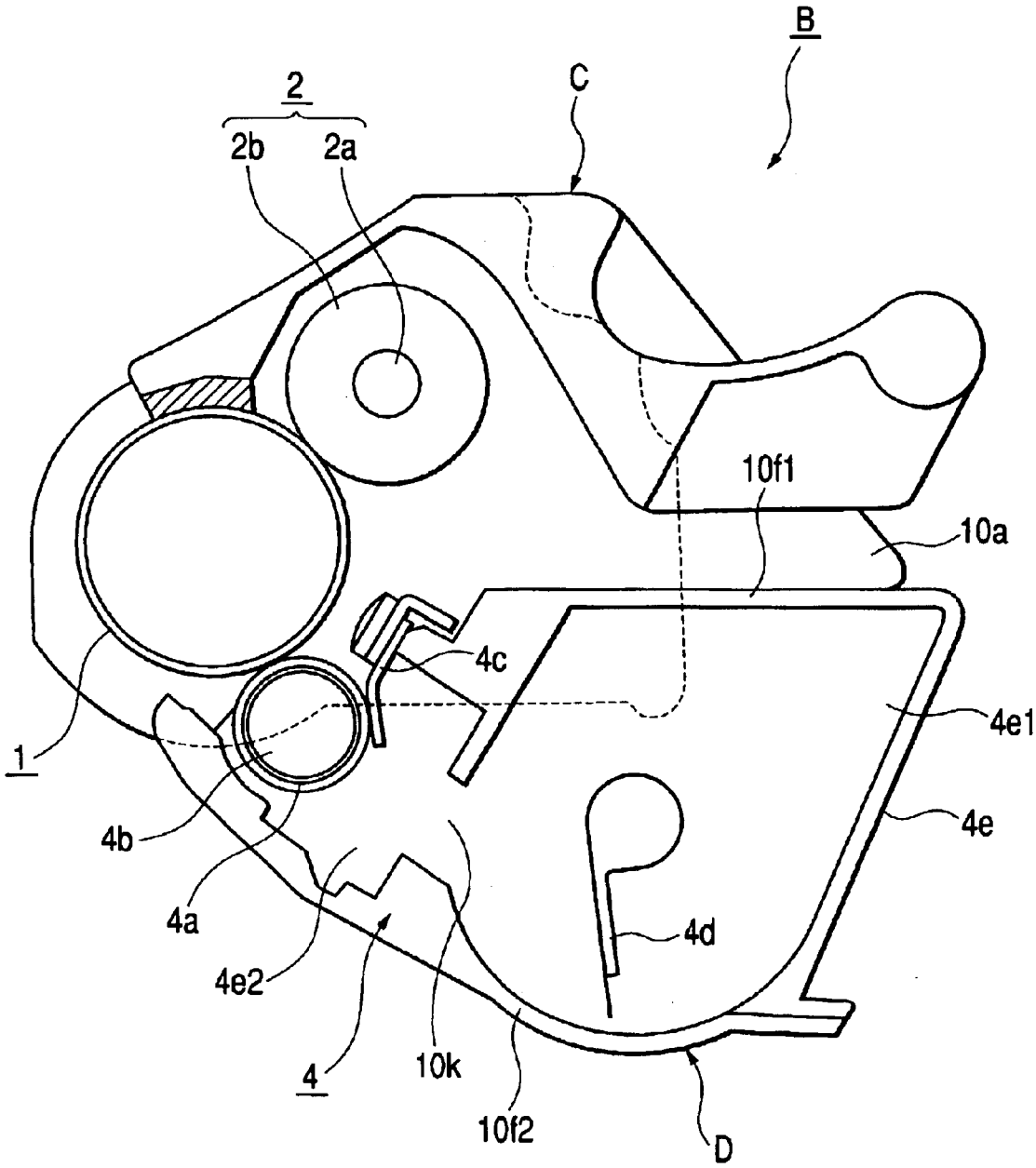
FIG. 11 is a schematic cross-sectional view of a process cartridge.

FIG. 10 is a typical illustration showing the construction of an electrophotographic image-forming apparatus having a process cartridge mounted thereon, and FIG. 11 is a typical illustration showing the construction of the process cartridge.

The basic construction of the electrophotographic image-forming apparatus 100, which is a laser beam printer shown in FIG. 10, is similar to that which has been described with reference to FIG. 1, and utilizes a transfer-type electrophotographic process, and adopts a direct injection-charging process and a toner-recycle process (cleanerless system).

The letter A designates an image-forming-apparatus main body, and the letter B denotes the process cartridge. The process cartridge B, in the present embodiment, includes a photosensitive drum 1, a charging roller 2 and a developing apparatus 4, and is detachably mounted with respect to process cartridge mounting means 10*b* provided in the image-forming-apparatus main body A, by the use of guide portions, not shown, provided in the opposite end portions of the process cartridge.

The photosensitive drum 1 is charged by the charging roller 2, and image-information exposure light L from an optical system 3 is projected on the photosensitive drum 1 through the exposure opening portion 10*a* of the process cartridge B, whereby a latent image is formed on the photosensitive drum 1, and the latent image is developed with a developer (toner) by the developing apparatus 4 and a toner image is formed.

In synchronism with the forming of the toner image on the photosensitive drum 1, transfer materials P, as recording media, are separated and fed one by one from a feed cassette 8*a* containing the transfer materials P therein by a pickup roller 8*b* and a pressure contact member 8*c* brought into pressure contact therewith, and are transported by transporting means 8*e*.

The toner image formed on the photosensitive drum 1 is then transferred to the transfer material P by a voltage being applied to a transfer roller 6 as transferring means, and the transfer material P is transported to fixing means 7 by transporting means 8*f*.

The fixing means 7 comprises a driving roller 7*a* and a fixing rotary member 7*d* containing a heater 7*b* therein and comprised of a cylindrical sheet rotatably supported by a supporting member 7*c*, and applies heat and pressure to the transfer material P passing there to thereby fix the transferred toner image. Then, this transfer material P is transported by a pair of delivery rollers 8*d*, and is delivered to a delivery portion 9 through a surface-reverse transporting path.

As shown in FIG. 11, the process cartridge B in the present embodiment includes the photosensitive drum 1, the charging roller 2 and the developing apparatus 4, and is constituted by integrally assembling a drum frame unit C for holding the photosensitive drum 1 and the charging roller 2, and a developing unit D constituting the developing apparatus 4.

The design of the apparatus is made such that the photosensitive drum 1, which is an electrophotographic photosensitive member having a photosensitive layer, is rotated, and a voltage is applied to the charging roller 2, which is charging means, to thereby uniformly charge the surface of the photosensitive drum 1, and this charged photosensitive drum 1 is exposed to an optical image from the optical system 3 through the exposure-opening portion 10*a*, to thereby form a latent image, and the latent image is developed by the developing apparatus 4, which is developing means.

The developing apparatus 4 feeds toner to a developing chamber 4*e*2 by a rotatable toner-feeding member (agitating member) 4*d*, which is toner-feeding means, in the developer-containing portion 4*e*1 of a developing container 4*e* formed by a toner-containing frame 10*f*1 and a lid member 10*f*2, through the opening portion 10*k* of the developer-containing portion 4*e*1, and rotates a developing roller 4*a*, which is a rotary developing member (developer-bearing member) containing a stationary magnet 4*b* therein, and also forms on the surface of the developing roller 4*a* a toner layer given triboelectrification charges by a developing blade 4*c*, and shifts the toner to the photosensitive drum 1 in conformity with the latent image on the photosensitive drum 1, to thereby form a toner image and visualize the latent image.

Then, a voltage opposite in polarity to the toner image is applied to the transfer roller 6 to thereby transfer the toner image to the transfer material P. Any untransferred toner residual on the photosensitive drum 1 is collected by the developing apparatus 4 during the developing after the next step.

With the exception that the image-forming apparatus is of a process-cartridge, detachably-mounting type, in the present embodiment, the construction and disposition of the photosensitive drum 1, which is an image-bearing member, and the charging roller 2, and the details of the toner t, the electroconductive particles m, etc., all correspond to those in Embodiment 1.

Accordingly, here, the overlapping description of these need not be made and the whole description of Embodiment 1 is invoked.

According to the present embodiment, particle charging (powder-applying type) according to the present invention is applied to the image-forming apparatus of the process-cartridge detachably-mounting type, whereby the charging performance by a direct injection-charging mechanism is further improved and moreover, the cleanerless system is adopted, and the electroconductive particles m are supplied from the developing apparatus, whereby the process cartridge and the image-forming-apparatus main body can be markedly downsized and reduced in cost.

<Other Embodiments>

(1) While in the above-described embodiments, a laser-beam printer has been shown as the image-forming apparatus, the present invention is not restricted thereto, but can of course be also applied to other image-forming apparatuses, such as an electrophotographic copying machine, a facsimile apparatus, and a word processor.

(2) In the case of an electrostatic recording apparatus, the image-bearing member is an electrostatic-recording dielectric member.

(3) The image-bearing member is not limited to a drum shape, but may also be of an endless-belt shape or a belt shape having ends, or a sheet shape.

(4) The contact-charging member is not limited to a roller shape, but may also be of an endless-belt shape or a belt shape having ends.

(5) As the developing method, use can be made of one of various conventional developing methods, such as a two-component magnetic-brush developing method, a cascade developing method, a touch-down developing method, and a cloud developing method.

(6) While in the above-described embodiments, the electroconductive particles have been described as being supplied to the charging member by the developing apparatus as supplying means through the image-bearing member simultaneously with developing, the present invention is not restricted thereto. Supplying means exclusively for supplying the electroconductive particles to the charging member through the image-bearing member may be provided upstream of the charging member with respect to the direction of movement of the surface of the image-bearing member. Also, the design of the apparatus may be made such that the electroconductive particles are directly supplied to the charging member by supplying means without the intermediary of the image-bearing member.

(7) A transferred member for receiving the transfer of the toner image from the image-bearing member may be an intermediate transfer member, such as a transfer drum or a transfer belt.

Also, the image-bearing member, which is a member to be charged, and the charging member need not be provided in the process cartridge as in Embodiment 1.

While the cleanerless process has been shown in the above-described embodiments, a provision may be made of a cleaner for removing the residual toner on the image-bearing member. When the cleaner is provided, it is preferable that the supply of the electroconductive particles to the charging member be directly effected by electroconductive particle-supplying means without the intermediary of the image-bearing member.

The present invention is not restricted to the above-described embodiments, but all modifications are possible within the scope of the technical idea of the present invention.

What is claimed is:

1. A charging system comprising:

a rotatable member to be charged; and a rotatable charging member configured and positioned to form a nip part with said member to be charged, and to charge said member to be charged, wherein electroconductive particles are provided in said nip part, wherein when the diameter of said member to be charged is denoted as LD in units of millimeters and the diameter of said charging member is denoted as LC in units of millimeters, $LD \leqq 25$ and $LD \times LC \geqq 350$ are satisfied.

2. A charging system according to claim 1, wherein said charging member rotates with a peripheral velocity different from the peripheral velocity of said member to be charged.

3. A charging system according to claim 1, wherein when the length of said nip part in the direction of rotation of said member to be charged is denoted as N in units of millimeters, and the push-in amount of said charging member relative to said member to be charged is denoted as δ in units of millimeters, the expression $N \geqq 6.0\delta + 1.35$ is satisfied.

4. A charging system according to claim 1, wherein a surface of said charging member is provided with an elastic foamed material.

5. A charging system according to claim 4, wherein when the surface roughness of said charging member is denoted as Ra in units of millimeters, and the push-in amount of said charging member relative to said member to be charged is denoted as δ in units of millimeters, the expression $Ra \leqq \delta$ is satisfied.

6. A charging system according to claim 1, wherein when the surface roughness of said charging member is denoted as Ra in units of microns, Ra is 1 μm to 500 μm.

7. A charging system according to claim 1, wherein the diameter LD of said member to be charged and the diameter LC of said charging member satisfy $LC \leqq LD$.

8. A charging system according to claim 1, wherein the diameter LD of said member to be charged satisfies $LD \geqq 15$.

9. A charging system according to claim 1, wherein a surface of said charging member is provided with an elastic material, and when the thickness of said elastic material is denoted as t in units of millimeters, and the length of said nip part in the direction of rotation of said member to be charged is denoted as N in units of millimeters, and the push-in amount of said charging member relative to said member to be charged is denoted as δ in units of millimeters, $0.01 \leqq \delta/t \leqq 0.03N - 0.02$ and $1 \leqq N \leqq 4$ are satisfied.

10. A charging system according to claim 1, wherein a surface of said charging member is provided with a foamed material, and wherein the cell diameter of said foamed material is 1 to 500 μm.

11. A charging system according to claim 1, wherein the particle diameter of said electroconductive particles is 10 nm to 10 μm.

12. A charging system according to claim 1, wherein the value obtained by dividing a borne amount of said electroconductive particles borne by said charging member by the surface roughness Ra in units of microns of said charging member is 0.005 to 1 $mg/cm^2/\mu m$.

13. A charging system according to claim 1, wherein when the covering rate of said electroconductive particles covering said charging member in said nip part is denoted as Rc, then $1 \geqq Rc \geqq 0.2$.

14. A charging system according to claim 1, wherein said charging member is roller shaped.

15. A process cartridge detachably mountable with respect to a main body of an image forming apparatus, said process cartridge comprising:

a rotatable member to be charged, said member to be charged being capable of bearing an image thereon;

a rotatable charging member configured and positioned to form a nip part with said member to be charged, and to charge said member to be charged, wherein electroconductive particles are provided in said nip part;

wherein when the diameter of said member to be charged is denoted as LD in units of millimeters and the diameter of said charging member is denoted as LC in units of millimeters, $LD \leqq 25$ and $LD \times LC \geqq 350$ are satisfied.

16. A process cartridge according to claim 15, wherein said charging member rotates with a peripheral velocity different from the peripheral velocity of said member to be charged.

17. A process cartridge according to claim 15, wherein when the length of said nip part in the direction of rotation of said member to be charged is denoted as N in units of millimeters, and the push-in amount of said charging member relative to said member to be charged is denoted as δ in units of millimeters, the expression $N \geqq 6.0\delta+1.35$ is satisfied.

18. A process cartridge according to claim 15, wherein a surface of said charging member is provided with an elastic foamed material.

19. A process cartridge according to claim 18, wherein when the surface roughness of said charging member is denoted as Ra in units of millimeters, and the push-in amount of said charging member relative to said member to be charged is denoted as δ in units of millimeters, the expression $Ra \leqq \delta$ is satisfied.

20. A process cartridge according to claim 15, wherein when the surface roughness of said charging member is denoted as Ra in units of microns, Ra is 1 μm to 500 μm.

21. A process cartridge according to claim 15, wherein the diameter LD of said member to be charged and the diameter LC of said charging member satisfy $LC \leqq LD$.

22. A process cartridge according to claim 15, wherein the diameter LD of said member to be charged satisfies $LD \geqq 15$.

23. A process cartridge according to claim 15, wherein a surface of said charging member is provided with an elastic material, and when the thickness of said elastic material is denoted as t in units of millimeters, and the length of said nip part in the direction of rotation of said member to be charged is denoted as N in units of millimeters, and the push-in amount of said charging member relative to said member to be charged is denoted as δ in units of millimeters, $0.01 \leqq \delta/t \leqq 0.03N-0.02$ and $1 \leqq N \leqq 4$ are satisfied.

24. A process cartridge according to claim 15, wherein a surface of said charging member is provided with a foamed material, and the cell diameter of said foamed material is 1 to 500 μm.

25. A process cartridge according to claim 15, wherein the particle diameter of said electroconductive particles is 10 nm to 10 μm.

26. A process cartridge according to claim 15, wherein the value obtained by dividing a borne amount of said electroconductive particles borne by said charging member by the surface roughness Ra in units of microns of said charging member is 0.005 to 1 $mg/cm^2/\mu m$.

27. A process cartridge according to claim 15, wherein when the covering rate of said electroconductive particles covering said nip part of said charging member is denoted as Rc, $1 \geqq Rc \geqq 0.2$.

28. A process cartridge according to claim 15, wherein said charging member is roller shaped.

29. A process cartridge according to claim 15, further comprising developing means for developing an electrostatic image formed on said member to be charged with a developer.

30. A process cartridge according to claim 29, wherein the developing operation of said developing means also collects any residual developer on said member to be charged.

31. A process cartridge according to claim 30, wherein the developer includes said electroconductive particles, wherein said developing means supplies said electroconductive particles to said member to be charged, and wherein said member to be charged can supply said electroconductive particles to said charging member.

32. An image forming apparatus comprising:

a rotatable member to be charged;

a rotatable charging member configured and positioned to form a nip part with said member to be charged, and to charge said member to be charged, wherein electroconductive particles are provided in said nip part; and image forming means for forming an image on said member to be charged, wherein when the diameter of said member to be charged is denoted as LD in units of millimeters, and the diameter of said charging member is denoted as LC in units of millimeters, $LD \leqq 25$ and $LD \times LC \geqq 350$ are satisfied.

33. An image forming apparatus according to claim 32, wherein said charging member is rotated with a peripheral velocity different from the peripheral velocity of said member to be charged.

34. An image forming apparatus according to claim 32, wherein when the length of said nip part in a direction of rotation of said member to be charged is denoted as N in units of millimeters, and the push-in amount of said charging member relative to said member to be charged is denoted as δ in units of millimeters, the expression $N \geqq 6.0\delta+1.35$ is satisfied.

35. An image forming apparatus according to claim 32, wherein a surface of said charging member is provided with an elastic foamed material.

36. An image forming apparatus according to claim 35, wherein when the surface roughness of said charging member is denoted by Ra in units of millimeters, and the push-in amount of said charging member relative to said member to be charged is denoted as δ in units of millimeters, the expression $Ra \leqq \delta$ is satisfied.

37. An image forming apparatus according to claim 32, wherein when the surface roughness of said charging member is denoted as Ra in units of microns, Ra is 1 μm–500 μm.

38. An image forming apparatus according to claim 32, wherein the diameter LD of said member to be charged and the diameter LC of said charging member satisfy $LC \leqq LD$.

39. An image forming apparatus according to claim 32, wherein the diameter LD of said member to be charged satisfies $LD \geqq 15$.

40. An image forming apparatus according to claim 32, wherein a surface of said charging member is provided with an elastic material, and when the thickness of said elastic material is denoted as t in units of millimeters, and the length of said nip part in the direction of rotation of said member to be charged is denoted by N in units of millimeters, and the push-in amount of said charging member relative to said member to be charged is denoted as δ in units of millimeters, $0.01 \leqq \delta/t \leqq 0.03N-0.02$ and $1 \leqq N \leqq 4$ are satisfied.

41. An image forming apparatus according to claim 32, wherein a surface of said charging member is provided with a foamed material, and the cell diameter of said foamed material is 1 to 500 μm.

42. An image forming apparatus according to claim 32, wherein the particle diameter of said electroconductive particles is 10 nm to 10 μm.

43. An image forming apparatus according to claim 32, wherein the value obtained by dividing a borne amount of said electroconductive particles borne by said charging member by the surface roughness Ra in units of microns of said charging member is 0.005 to 1 $mg/cm^2/\mu m$.

44. An image forming apparatus according to claim 32, wherein when the covering rate of said electroconductive particles covering said nip part of said charging member is denoted as Rc, $1 \geqq Rc \geqq 0.2$.

45. An image forming apparatus according to claim 32, wherein said charging member is roller shaped.

46. An image forming apparatus according to claim 32, further comprising developing means for developing an electrostatic image formed on said member to be charged with a developer.

47. An image forming apparatus according to claim 46, wherein the developing operation of said developing means also collects any residual developer on said member to be charged.

48. An image forming apparatus according to claim 47, wherein said developer includes said electroconductive particles, wherein said developing means supplies said electroconductive particles to said member to be charged, and wherein said member to be charged can supply said electroconductive particles to said charging member.

* * * * *

UNITED STATES PATENT AND TRADEMARK OFFICE

CERTIFICATE OF CORRECTION

PATENT NO. : 6,898,401 B2
DATED : May 24, 2005
INVENTOR(S) : Keiji Okano et al.

It is certified that error appears in the above-identified patent and that said Letters Patent is hereby corrected as shown below:

Title page,
Item [57], ABSTRACT,
Line 8, “result,,” should read -- result, --.

Column 1,
Line 46, “even” should be deleted.

Column 12,
Line 29, “amount/Ra)” should read -- amount/Ra”) --.

Column 15,
Line 16, “$Xn^2+Yn^2 Rd^2$” should read -- $Xn^2+Yn^2=Rd^2$ --.

Signed and Sealed this

Eleventh Day of October, 2005

JON W. DUDAS
*Director of the United States Patent and Trademark Office*